US010020619B2

(12) United States Patent
Zhang

(10) Patent No.: US 10,020,619 B2
(45) Date of Patent: Jul. 10, 2018

(54) ELECTRICAL CONNECTOR

(71) Applicant: Molex, LLC, Lisle, IL (US)

(72) Inventor: Xue-Hai Zhang, Jiangsu (CN)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/309,742

(22) PCT Filed: May 29, 2015

(86) PCT No.: PCT/IB2015/001227
§ 371 (c)(1),
(2) Date: Nov. 8, 2016

(87) PCT Pub. No.: WO2015/181630
PCT Pub. Date: Dec. 3, 2015

(65) Prior Publication Data

US 2017/0271822 A1 Sep. 21, 2017

(30) Foreign Application Priority Data

May 30, 2014 (CN) ..... 2014 2 0287956 U
May 30, 2014 (CN) ..... 2014 2 0289307 U

(51) Int. Cl.
*H01R 24/60* (2011.01)
*H01R 13/6594* (2011.01)
(Continued)

(52) U.S. Cl.
CPC ..... *H01R 13/6594* (2013.01); *H01R 12/7082* (2013.01); *H01R 13/652* (2013.01); *H01R 24/60* (2013.01); *H01R 2107/00* (2013.01)

(58) Field of Classification Search
CPC ..... H01R 13/6594; H01R 12/7082; H01R 13/652; H01R 24/60; H01R 13/6596; H01R 13/6585
(Continued)

(56) References Cited

U.S. PATENT DOCUMENTS 7,094,086 B2 8/2006 Teicher
7,758,379 B2 * 7/2010 Chen ..... H01R 13/6485 439/607.11
(Continued)

FOREIGN PATENT DOCUMENTS

CN 201107821 Y 12/2008
CN 201430237 Y 3/2010
(Continued)

*Primary Examiner* — Renee S Luebke
*Assistant Examiner* — Paul Baillargeon
(74) *Attorney, Agent, or Firm* — James A. O'Malley

(57) ABSTRACT

An electrical connector comprise: an insulative body comprising a body portion and a tongue portion extending forwards from the body portion; a plurality of conductive terminals divided into a group of first conductive terminals and a group of second conductive terminals, a mating portion of each first conductive terminal is exposed on a first surface of the tongue portion, a mating portion of each second conductive terminal is exposed on the second surface of the tongue portion; an outer shielding shell fixed on the insulative body, having at least a grounding soldering leg and enclosing an outer space of the tongue portion to form a mating cavity; and a grounding metal plate comprising a main plate and at least an extending portion extending from the main plate, the main plate is embedded in the tongue portion and spaces the first conductive terminals apart from the second conductive terminals, the extending portion extends out from at least a side of the insulative body and electrically contacts the outer shielding shell. The present disclosure may reliably provide a grounding circuit for the grounding metal plate without a grounding soldering pad additionally provided on a circuit board.

27 Claims, 19 Drawing Sheets

(51) Int. Cl.
*H01R 12/70* (2011.01)
*H01R 13/652* (2006.01)
*H01R 107/00* (2006.01)

(58) Field of Classification Search
USPC ..... 439/607.11, 607.28
See application file for complete search history.

(56) References Cited

U.S. PATENT DOCUMENTS

| | | | | |
|---|---|---|---|---|
| 7,771,235 | B2 | 8/2010 | Kameyama | |
| 8,109,795 | B2 | 2/2012 | Lin et al. | |
| 8,684,769 | B2 | 4/2014 | Kao et al. | |
| 8,968,031 | B2 * | 3/2015 | Simmel | H01R 13/659 439/108 |
| 9,306,336 | B2 * | 4/2016 | Chang | H01R 13/6471 |
| 9,312,641 | B2 | 4/2016 | Wang et al. | |
| 9,548,568 | B2 * | 1/2017 | Miyoshi | H01R 13/428 |
| 2007/0087629 | A1 | 4/2007 | Liang | |
| 2010/0210124 | A1 | 8/2010 | Li | |
| 2013/0244492 | A1 | 9/2013 | Golko et al. | |
| 2015/0255905 | A1 * | 9/2015 | Little | H01R 13/6658 439/78 |

FOREIGN PATENT DOCUMENTS

| | | | |
|---|---|---|---|
| JP | 09-199231 | A | 7/1997 |
| JP | 2010-067459 | A | 3/2010 |
| JP | 2014-032816 | A | 2/2014 |
| KR | 2011-0081361 | A1 | 7/2011 |
| WO | WO 2009-069969 | A2 | 6/2009 |
| WO | WO 2011-150403 | A1 | 12/2011 |

* cited by examiner

ELECTRICAL CONNECTOR

RELATED APPLICATIONS

This application is a national stage application of PCT Application No. PCT/IB2015/001227, filed May 29, 2015, which claims priority to Chinese Application No. 201420287956.X, filed May 30, 2014, and Chinese Application No. 201420289307.3, filed May 30, 2014, all of which are incorporated herein by reference in their entirety.

TECHNICAL FIELD

The present disclosure relates to an electrical connector, and particularly relates to an electrical connector which may reliably provide a grounding circuit for a grounding metal plate.

BACKGROUND ART

Chinese patent application CN201320378153.0 discloses an electrical connector which comprises an insulative body, a group of first terminals fixed to the insulative body, a shielding member and a metal shell provided outside the insulative body, the insulative body comprises a base portion and a tongue extending forwards, the tongue has a first surface and a second surface which are provided oppositely, the first terminals are exposed on the first surface, the shielding member is provided to the tongue and is positioned between the first surface and the second surface, the first terminals comprises a grounding terminal, the grounding terminal is provided with a contact portion protruding toward the shielding member and contacting the shielding member.

With such a structure, a grounding circuit is additionally established by that the shielding member contacts the contact portion of the grounding terminal bent toward the shielding member and formed with a pointed arch shape. Due to lack of elasticity, the contact portion with the pointed arch shape neither easily provides a stable contact nor has a good grounding effect, and the grounding terminal also easily results in that contact between the contact portion with the pointed arch shape and the shielding member cannot be maintained due to slight offset or deformation of the grounding terminal during assembling, the grounding circuit provided by such a structure is not reliable enough. However, grounding established via a soldering leg of the shielding member requires a soldering pad to be specially provided on a circuit board for the soldering leg, which will increase the number of the soldering pads on the circuit board and complexity of the grounding circuit.

SUMMARY

The technical problem to be resolved by the present disclosure is to provide an electrical connector which may reliably provide a grounding circuit for a grounding metal plate without a grounding soldering pad additionally provided on a circuit board so as to overcome the deficiency existing in the prior art.

In view of the above technical problems, the present disclosure provides an electrical connector which comprises: an insulative body comprising a body portion and a tongue portion extending forwards from the body portion, the tongue portion has a first surface and a second surface which are opposite along an up-down direction; a plurality of conductive terminals divided into a group of first conductive terminals and a group of second conductive terminals, each conductive terminal comprises a mating portion extending forwards onto the tongue portion and a soldering portion extending out of the body portion, the mating portion of each first conductive terminal is exposed on the first surface of the tongue portion, the mating portion of each second conductive terminal is exposed on the second surface of the tongue portion; an outer shielding shell fixed on the insulative body, having at least a grounding soldering leg and enclosing an outer space of the tongue portion to form a mating cavity; and a grounding metal plate comprising a main plate and at least an extending portion extending from the main plate, the main plate is embedded in the tongue portion and spaces the first conductive terminals apart from the second conductive terminals, the extending portion extends out from at least a side of the insulative body and electrically contacts the outer shielding shell.

In an embodiment, a distal end of the extending portion is formed as a contact portion; the outer shielding shell is provided with at least a fixing groove corresponding to the extending portion so as to allow the contact portion to be inserted into the fixing groove.

In an embodiment, the fixing groove has a bottom edge extending horizontally and an incline edge extending inclinely, the contact portion is locked at a position of the fixing groove where the bottom edge and the incline edge are jointed.

In an embodiment, the fixing groove has an arc shape, the contact portion is locked in the fixing groove with the arc shape.

In an embodiment, the fixing groove has a plurality of arc edges, the arc edges allow the fixing groove to form a wide section and two narrow sections respectively positioned at a front side and a rear side of the wide section; the contact portion is provided with a notch thereon, the notch correspondingly is locked at the wide section of the fixing groove, other portions of the contact portion are locked at the narrow sections of the fixing groove.

In an embodiment, the outer shielding shell comprises a top wall, a bottom wall opposite to the top wall and two side walls connected between the top wall and the bottom wall, each of the two side walls of the outer shielding shell is provided with the one fixing groove; the grounding metal plate comprises the two extending portions, each extending portion protrudes outwards from a side of the body portion of the insulative body and correspondingly latches on to the one fixing groove of the outer shielding shell.

In an embodiment, the tongue portion further comprises a front surface and two side surfaces which are positioned between the first surface and the second surface; the grounding metal plate further comprises two protective portions extending respectively from two sides of a front end of the main plate, each protective portion at least comprises a smooth guiding surface exposed on a transitional position between the front surface and the side surfaces of the tongue portion.

In an embodiment, each protective portion is bent and extends perpendicular to the main plate; each of two side surfaces of the tongue portion is provided with a latching groove recessed inwards, the protective portion further comprises a latching surface exposed on the latching groove.

In an embodiment, the electrical connector further comprises an inner shielding shell, the inner shielding shell is positioned between the outer shielding shell and the insulative body, and surrounds a rear section of the tongue portion of the insulative body and a part of the body portion adjacent to the tongue portion.

In an embodiment, the grounding metal plate further comprises at least a grounding soldering leg extending from the main plate.

In an embodiment, the extending portion of the grounding metal plate is a grounding soldering leg, the grounding soldering leg of the grounding metal plate attaches on the grounding soldering leg of the outer shielding shell.

In an embodiment, the outer shielding shell has two grounding soldering legs extending downwards respectively from two sides of the outer shielding shell; the grounding metal plate comprises two grounding soldering legs respectively extending from two sides of the main plate.

In an embodiment, the outer shielding shell is opened with two receiving grooves respectively above the two grounding soldering legs of the outer shielding shell, the grounding soldering leg of the grounding metal plate correspondingly passes through the receiving groove and then attaches on the grounding soldering leg of the outer shielding shell from the outside of the grounding soldering leg of the outer shielding shell and extends downwards.

In an embodiment, the receiving groove is opened rearwards, the grounding soldering leg of the grounding metal plate is horizontally inserted into the receiving groove from rear to front and is fixed in the receiving groove.

In an embodiment, the grounding soldering leg of the grounding metal plate and the grounding soldering leg of the outer shielding shell are in form of via soldering, and can be correspondingly soldered to the same grounding soldering via of a circuit board.

In an embodiment, the grounding soldering leg of the outer shielding shell and/or the grounding soldering leg of the grounding metal plate each are provided with a grabbing solder hole.

In an embodiment, the grounding metal plate further comprises two connecting portions extending rearwards from a rear edge of the main plate, a beam extending transversally and connected with the two connecting portions, the beam is embedded in the body portion of the insulative body and extends outwards from two sides of the body portion, the two grounding soldering legs of the grounding metal plate are bent downwards from two ends of the beam and extend respectively.

In an embodiment, the first conductive terminals, the second conductive terminals and the grounding metal plate are embedded in a first insulative member, a second insulative member and a third insulative member, respectively; the first insulative member is provided on the third insulative member, the first insulative member and the second insulative member interpose the third insulative member therebetween.

In an embodiment, the third insulative member is provided with the tongue portion thereon, the first surface of the tongue portion is formed with a group of first terminal receiving grooves thereon, the second surface of the tongue portion is formed with a group of second terminal receiving grooves thereon; the mating portions of the first conductive terminals are correspondingly received in the first terminal receiving grooves, the mating portions of the second conductive terminals are correspondingly received in the second terminal receiving grooves.

In an embodiment, a rear portion of the third insulative member is provided with a plurality of terminal receiving grooves for correspondingly receiving the second conductive terminals.

In comparison with the prior art, the electrical connector of the present disclosure may reliably provide a grounding circuit for the grounding metal plate by allowing the extending portion of the grounding metal plate to contact the outer shielding shell and then to be grounded via the grounding soldering legs of the outer shielding shell, thereby facilitating transmission of high frequency signals, so that interference between high frequency signals of the two groups of conductive terminals may be reduced; also, such a structure does not require a grounding soldering pad to be additionally provided on the circuit board.

DETAILED DESCRIPTION OF THE PREFERRED EMBODIMENTS

Figure 1:
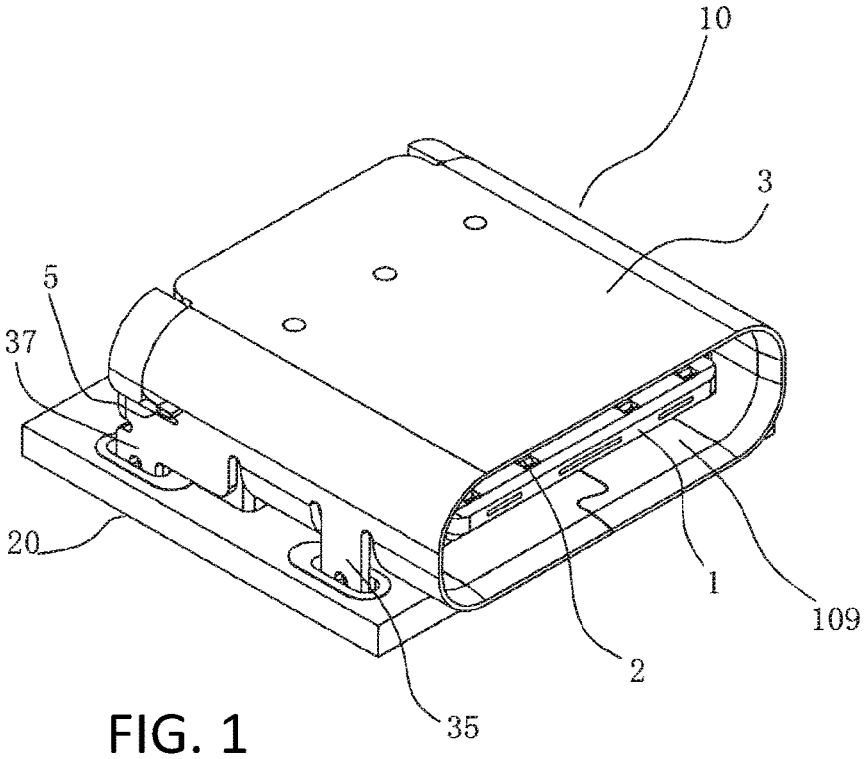
FIG. 1 is a view illustrating an electrical connector of a first embodiment of the present disclosure and a circuit board.
Figure 2:
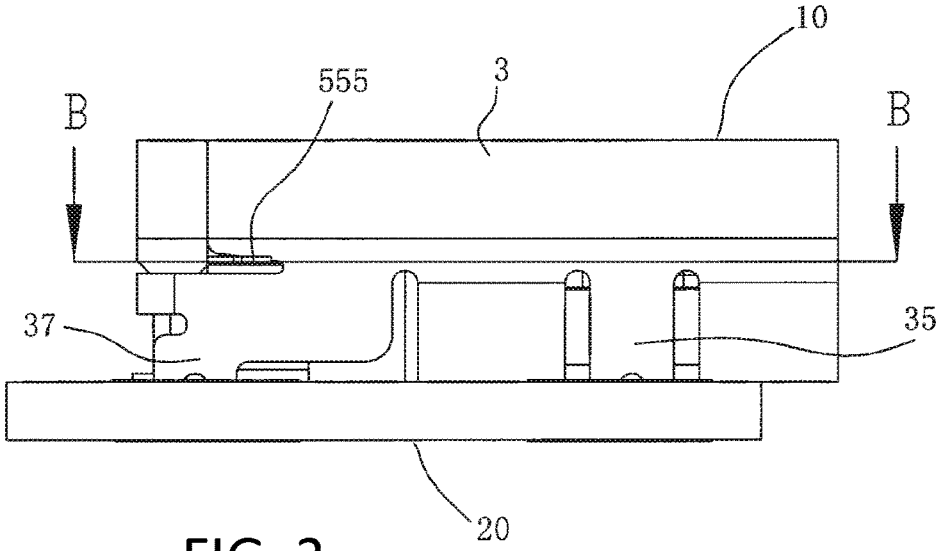
FIG. 2 is a side view of the electrical connector and the circuit board of FIG. 1.

While the present disclosure may be susceptible to embodiment in different forms, there is shown in the Figures, and will be described herein in detail, specific embodiments, with the understanding that the disclosure is to be considered an exemplification of the principles of the present disclosure, and is not intended to limit the present disclosure to that as illustrated.

As such, references to a feature are intended to describe a feature of an embodiment of the present disclosure, not to imply that every embodiment thereof must have the described feature. Furthermore, it should be noted that the description illustrates a number of features. While certain features have been combined together to illustrate potential system designs, those features may also be used in other combinations not expressly disclosed. Thus, the depicted combinations are not intended to be limiting, unless otherwise noted.

In the illustrated embodiments, directional representations (such as up, down, left, right, front, rear and the like) used for explaining the structure and movement of the various elements of the present disclosure, are not absolute, but relative. These representations are appropriate when the elements are in the position shown in the Figures. If the description of the position of the elements changes, however, it is assumed that these representations are to be changed accordingly.

Hereinafter, embodiments of the present disclosure will be described in detail in combination with the Figures. Referring to FIG. 1 to FIG. 8, an electrical connector of a first embodiment of the present disclosure is illustrated.

Referring to FIG. 1 to FIG. 4, an electrical connector 10 is an electrical connecting receptacle supporting a high data transmission rate, the electrical connector 10 may be mounted on a circuit board 20. The circuit board 20 is provided with a group of first soldering pads 201 and a group of second soldering pads 202 which are staggered with each other along a transversal direction and arranged along a front-rear direction on a rear portion of the circuit board 20. The circuit board 20 is further provided with two front grounding soldering pads 205 and two rear grounding soldering pads 207. Here, the first soldering pads 201 and the second soldering pads 202 are in form of surface mount technology, the grounding soldering pads 205, 207 are in form of via.

The electrical connector 10 generally comprises: an insulative body 1, a plurality of conductive terminals 2 provided to the insulative body 1, an outer shielding shell 3 sheathed and fixed around an outer periphery of the insulative body 1, an inner shielding shell 4 fixed between the outer shielding shell 3 and the insulative body 1 and a grounding metal plate 5 embedded in the insulative body 1. The outer shielding shell 3 is enclosed to form a mating cavity 109 provided as symmetry of 180 degrees. The conductive terminals 2 can be soldered onto the two groups of soldering pads 201, 202 of the circuit board 20 by surface mount technology. The outer shielding shell 3 has a plurality of grounding soldering legs 35, 37, the grounding soldering legs 35, 37 may be soldered to the grounding soldering pads 205, 207 of the circuit board 20, respectively.

Referring to FIG. 5 to FIG. 8, the insulative body 1 comprises a body portion 14 and a tongue portion 16 extending forwards from the body portion 14. Wherein the body portion 14 is relatively wide and large and the tongue portion 16 is relatively narrow and long. Specifically, the insulative body 1 is formed by assembling a first insulative member 11, a second insulative member 12 and a third insulative member 13.

The first insulative member 11 mainly comprises a base portion 111 with a rectangular parallelepiped shape, two fixed portions 112 respectively provided on two opposite sides of the base portion 111 and extending vertically, two receiving channels 113 provided on a top side of the base portion 111, and two fixing grooves provided on the base portion 111. Specifically, each fixed portion 112 is a protruding rail extending vertically.

The second insulative member 12 mainly comprises a base portion 121 with a rectangular parallelepiped shape, two fixed portions 122 respectively provided on two opposite sides of the base portion 121 and extending vertically, two receiving channels provided on a bottom side of the base portion 121, and two fixing grooves 124 provided on the base portion 121. Specifically, each fixed portion 122 is a protruding rail extending vertically.

The third insulative member 13 mainly comprises a main portion 15 and a tongue portion 16 extending forwards from a front side of the main portion 15. The main portion 15 generally comprises two opposite extending side portions 152 and a strengthening rib 155 transversely connected between the two extending side portions 152. The main portion 15 is formed with a receiving space 153 penetrating along an up-down direction. The first insulative member 11 and the second insulative member 12 are respectively fixed at a lower part and an upper part of the receiving space 153 and abut against each other. The tongue portion 16 further extends forwards from a front end of the two extending side portions 152. Two opposite inner sides of lower parts of the two extending side portions 152 each are provided with a first mounting portion. Two opposite inner sides of upper parts of the two extending side portions 152 each are provided with a second mounting portion 1522. Specifically, the first mounting portion is a first channel extending vertically and recessed on the inner side of the lower part of the extending side portion 152, the first channel is opened at a lower end of the extending side portion 152. The second mounting portion 1522 is a second channel extending vertically and recessed on the inner side of the upper part of the extending side portion 152, the second channel is opened at an upper end of the extending side portion 152. The extending side portion 152 is further formed with a position limit block 1526 protruding upwards at a rear end of a top surface of the extending side portion 152.

The tongue portion 16 has a first surface (a lower side surface) 168 and a second surface (an upper side surface) 169 which are relative wide and large and opposite along the up-down direction and a front surface 1671 and two side surfaces 1672 connected between the first surface 168 and the second surface 169. The first surface 168 of the tongue portion 16 is formed with a group of first terminal receiving grooves 161 thereon. The second surface 169 of the tongue portion 16 is formed with a group of second terminal receiving grooves 162 thereon. The tongue portion 16 comprises a rear section 165 close to the body portion 14 and a front section 166 extending forwards from the rear section 165. A plurality of protruding ribs 1651 and a plurality of protruding ribs 1652 protrude respectively from a part of the first surface 168 and a part of the second surface 169 at the rear section 165 along a direction perpendicular to an extending direction of the tongue portion 16, a section of the terminal receiving groove 161 is formed between the two protruding ribs 1651 and a section of the terminal receiving groove 162 is formed between the two protruding ribs 1652.

Top surfaces of the protruding ribs 1651 are substantially flushed with each other, top surfaces of the protruding ribs 1652 are substantially flushed with each other, a distance between the top surface of the side protruding rib 1651 of the tongue portion 16 and the top surface of the side protruding rib 1652 of the tongue portion 16 which are positioned respectively at an upper side and a lower side of the tongue portion 16 defines a thickness of the rear section 165. The thickness of the rear section 165 is larger than a thickness of the front section 166. Such a structure may allow the tongue portion 16 to have a good strength so as to avoid damage from a mating connector. Two sides of the rear section 165 of the tongue portion 16 each are further formed with a receiving grooves 164.

Specifically, the two fixed portions 112 of the first insulative member 11 and the two first mounting portions of the third insulative member 13 are correspondingly engaged, so that the first insulative member 11 is inserted from down to up, mounted and fixed in the lower part of the receiving space 153. The two fixed portions 122 of the second insulative member 12 and the two second mounting portions 1522 of the third insulative member 13 are correspondingly engaged, so that the second insulative member 12 is inserted from up to down, mounted and fixed in the upper part of the receiving space 153, a bottom surface of the base portion 121 of the second insulative member 12 and a top surface of the base portion 111 of the first insulative member 11 abut against each other. Such an engaged structure may allow the first insulative member 11, the second insulative member 12 and the third insulative member 13 to be compactly engaged together to constitute the body portion 14 of the insulative body 1 (referring to FIG. 3).

Referring to FIG. 5 to FIG. 8, the conductive terminals 2 are integrally formed by punching and bending a metal plate. The conductive terminals 2 are divided into a group of first conductive terminals 21 and a group of second conductive terminals 22. Each first conductive terminal 21 comprises a mating portion 211, a soldering portion 212 and a connecting portion 213 connected between the mating portion 211 and the soldering portion 212. The mating portion 211 is correspondingly received in the first terminal receiving groove 161 and is exposed on the first surface 168 of the tongue portion 16. The soldering portion 212 extends rearwards out of the body portion 14 of the insulative body 1. The connecting portion 213 is embedded in the body portion 14. Similarly, each second conductive terminal 22 comprises a mating portion 221, a soldering portion 222 and a connecting portion 223 connected between the mating portion 221 and the soldering portion 222. The mating portion 221 is correspondingly received in the second terminal receiving groove 162 and is exposed on the second surface 169 of the tongue portion 16. The soldering portion 222 extends rearwards out of the body portion 14 of the insulative body 1. The connecting portion 223 is embedded in the body portion 14. Referring to FIG. 1 to FIG. 8, the mating portions 211 of the first conductive terminals 21 and the mating portions 221 of the second conductive terminals 22 are arranged as symmetry of 180 degrees in the mating cavity 109, so that a proper connection can be obtained when the mating connector is inserted into the electrical connector 10 in dual orientations.

Referring to FIG. 4 to FIG. 8, the outer shielding shell 3 comprises a top wall 31, two side walls 32 and a bottom wall 33. The front grounding soldering leg 35 extends downwards from a middle position of each side wall 32. The top wall 31 is recessed with some engaging portions 311. The bottom wall 33 is also recessed with some engaging portions. A rear part of each side wall 32 is formed with the rear grounding soldering leg 37 extending downwards therefrom. The rear portion of each side wall 32 is further formed with a latching piece 36. The rear portion of each side wall 32 is opened with a fixing groove 321 above the corresponding rear grounding soldering leg 37, the fixing groove 321 has an opening opened rearwards. Specifically, referring to FIG. 6, the fixing groove 321 is gradually narrow from rear to front, and specifically, in the present embodiment, the fixing groove 321 comprises a bottom edge 3211 extending horizontally and an incline edge 3212 inclinely extending upwards from front to rear. In other non-illustrated embodiments, the bottom edge 3211 and/or the incline edge 3212 each are not necessarily a straight edge, but may be changed as an arc edge with a certain radian, as long as a profile gradually narrow from rear to front is obtained. When the outer shielding shell 3 is sheathed onto the insulative body 1, a rear end of the side wall 32 will abut against the position limit block 1526 of the insulative body 1, so that the position limit block 1526 may block the opening of the fixing groove 321. The latching piece 36 may latch on to a rear side of the insulative body 1 after the latching piece 36 is bent, so as to allow the outer shielding shell 3 to be fixed on the insulative body 1.

Referring to FIG. 5 to FIG. 8, the inner shielding shell 4 is fixed around the outer periphery of the body portion 14, and is attached on and surrounds a rear section 165 of the tongue portion 16, and extends with a distance. Specifically, the inner shielding shell 4 comprises a fixed section 45 positioned in the rear thereof and attached on a front section of the body portion 14, an extending section 46 positioned in the front thereof and attached on the rear section 165 of the tongue portion 16, and a connecting section 47 vertically connected between the fixed section 45 and the extending section 46. The inner shielding shell 4 may be grounded by that the fixed section 45 contacts the outer shielding shell 3. Because the extending section 46 is supported on the protruding ribs 1651 and the protruding ribs 1652, an interval between one extending section 46 and the first conductive terminals 21 and an interval between the extending section 46 and the second conductive terminals 22 may be maintained.

Specifically, the inner shielding shell 4 is formed by engaging two metal shell members 41 along the up-down direction. Each metal shell member 41 has a step profile, and comprises a horizontal fixed plate 417 fixed on the body portion 14, a horizontal extending plate 418 attached on the rear section 165 of the tongue portion 16, and a vertical connecting plate 413 vertically connected between the horizontal fixed plate 417 and the horizontal extending plate 418. Two fixed protruding pieces 415 vertically extend from a rear edge of the horizontal fixed plate 417, the fixed protruding piece 415 preferably is a barb. Two latching hooks 414, 416 vertically extend respectively from two sides of the horizontal extending plate 418, a latching notch 4141 of the latching hook 414 is opposite to a latching notch 4161 of the latching hook 416.

The fixed protruding piece 415 of the metal shell member 41 positioned below is correspondingly inserted into the fixing groove of the first insulative member 11. The fixed protruding piece 415 of the metal shell member 41 positioned above is correspondingly inserted into the fixing groove 124 of the second insulative member 12. In addition, the latching hook 414 of one metal shell member 41 latches on to the latching hook 416 of the other metal shell member 41, so that the two metal shell members 41 may be locked with each other. Specifically, the latching hooks 414, 416 are latched on to each other in the receiving groove 164 of the insulative body 1, so as to surround the rear section 165 of the tongue portion 16 therein.

The inner shielding shell 4 may be grounded by that the inner shielding shell 4 is engaged with the engaging portions 311, 331 of the outer shielding shell 3 via laser welding or elastic contact.

Figure 3:
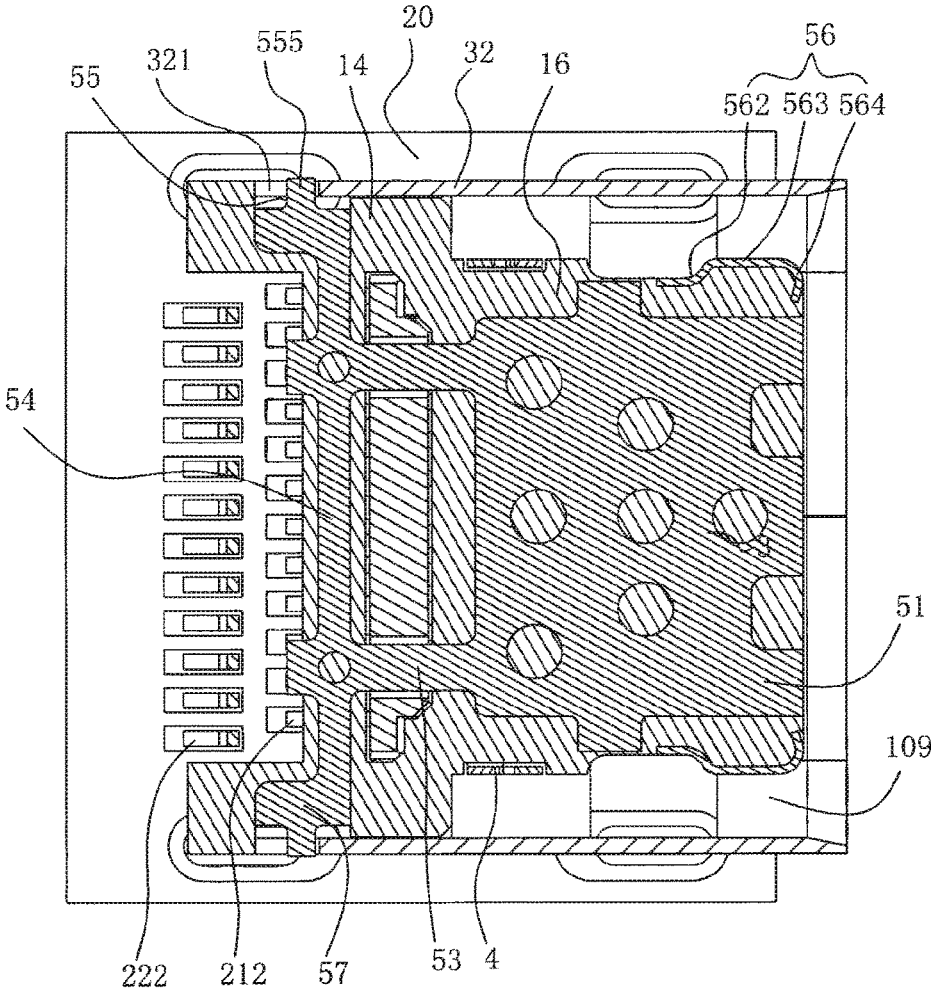
FIG. 3 is a cross sectional view taken along a line B-B of FIG. 2.
Figure 4:
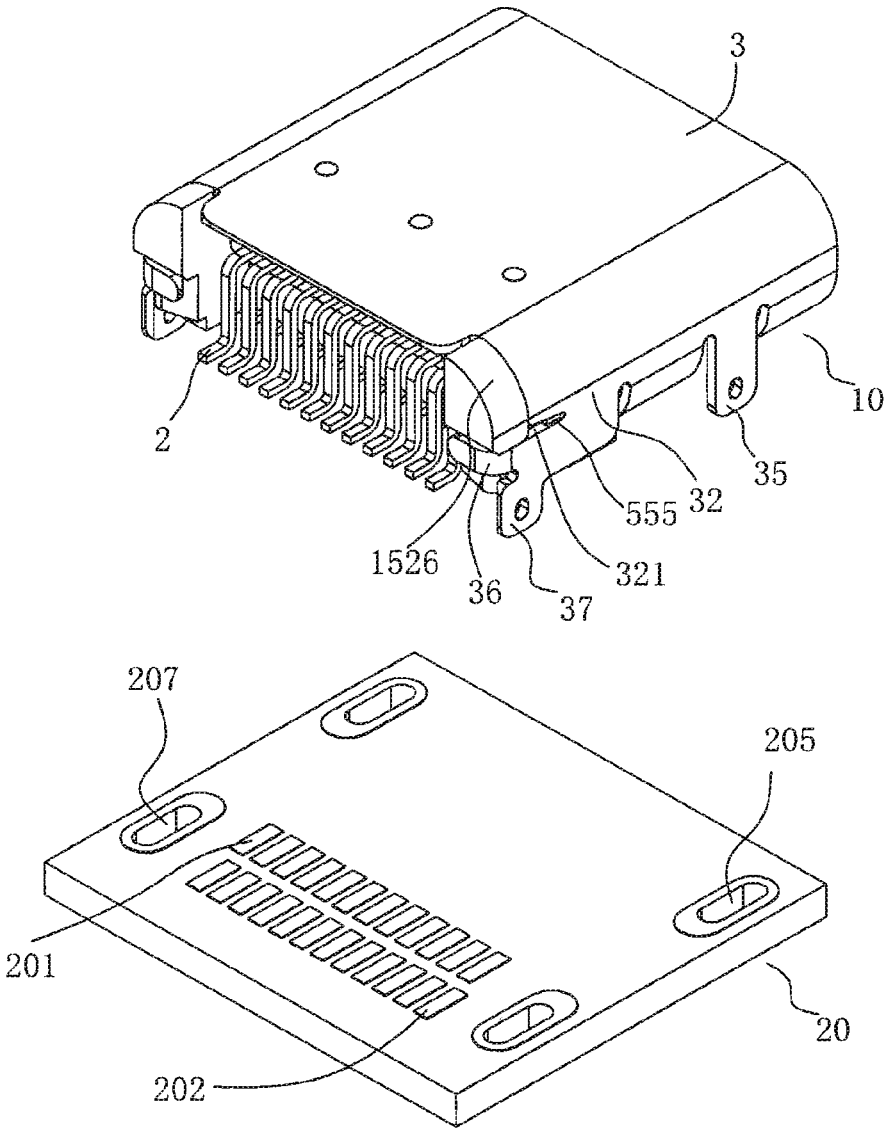
FIG. 4 is a view of FIG. 1 with the circuit board separated from the electrical connector.
Figure 5:
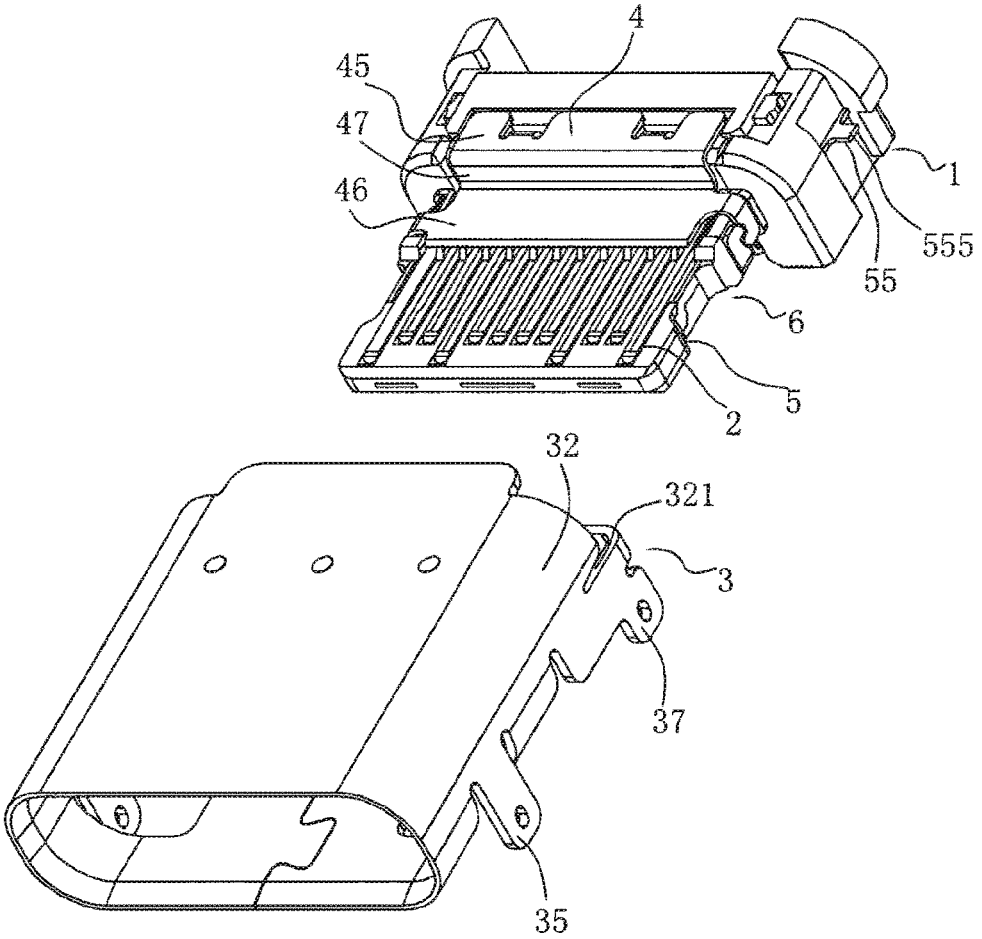
FIG. 5 is a view illustrating the electrical connector of the first embodiment of the present disclosure with an outer shielding shell separated therefrom.
Figure 6:
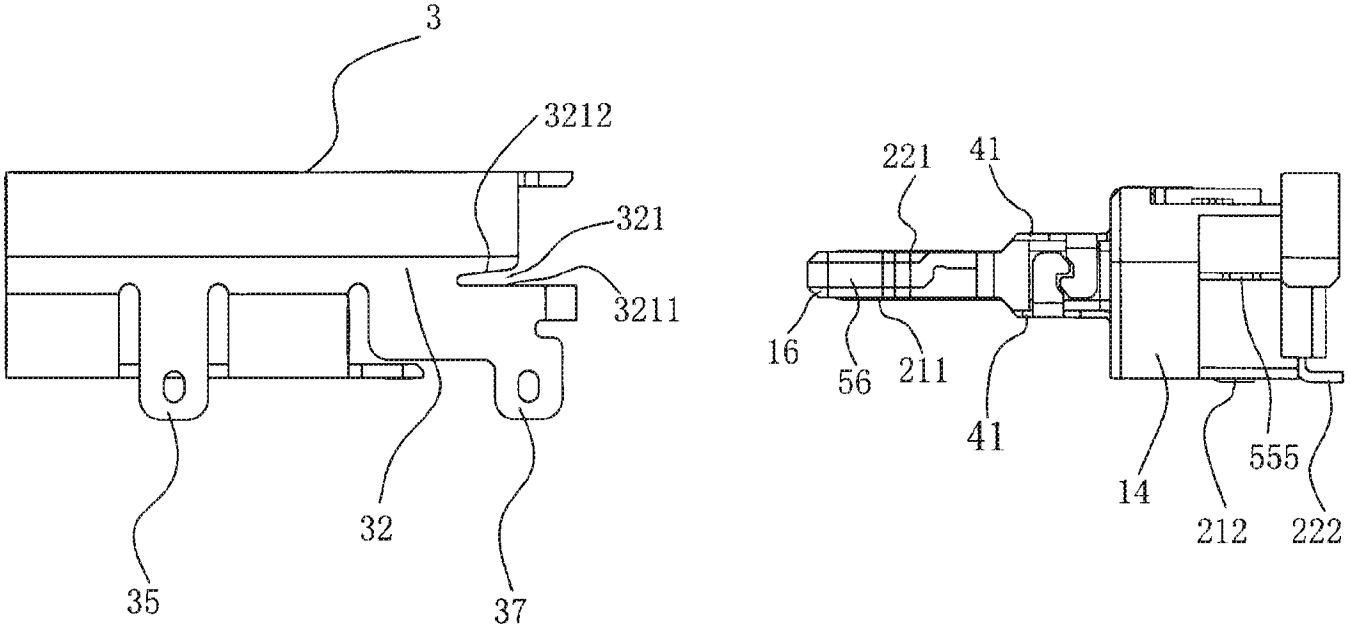
FIG. 6 is a side view of the electrical connector of FIG. 5.
Figure 8:
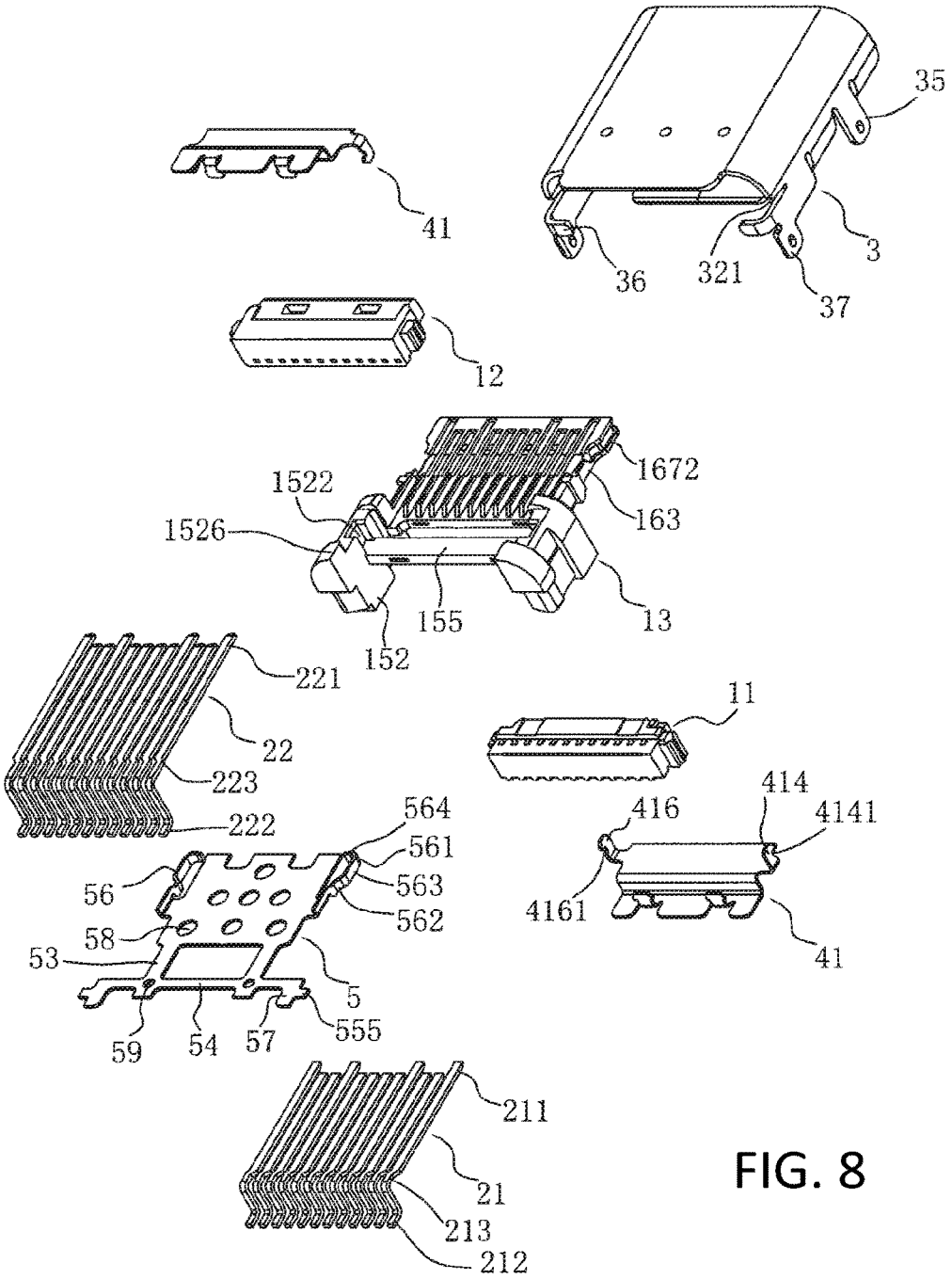
FIG. 8 is a view of FIG. 7 with conductive terminals, a grounding metal plate and an insulative body separated from each other.
Figure 9:
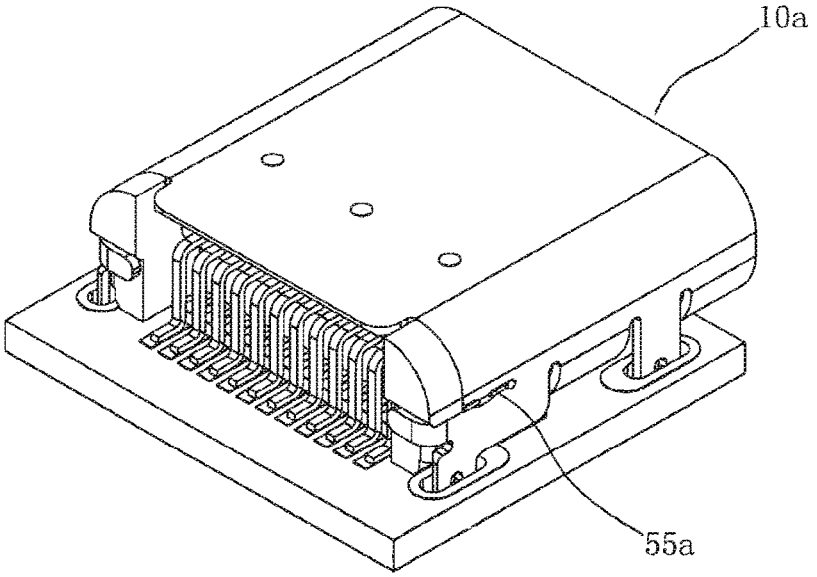
FIG. 9 is a view illustrating an electrical connector of a second embodiment of the present disclosure and a circuit board.
Figure 10:
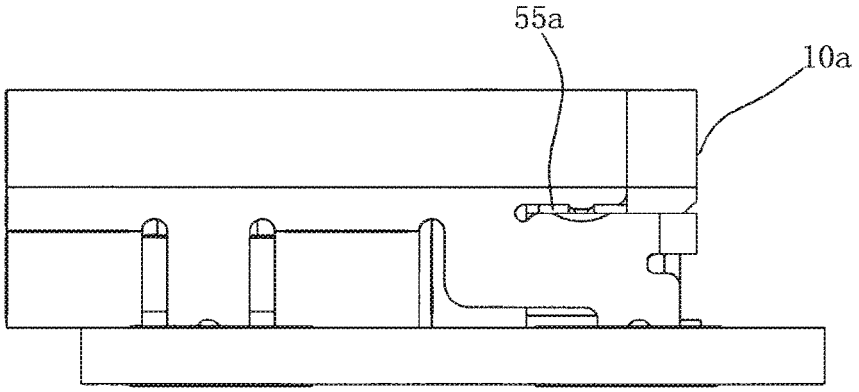
FIG. 10 is a side view of the electrical connector and the circuit board of FIG. 9.
Figure 11:
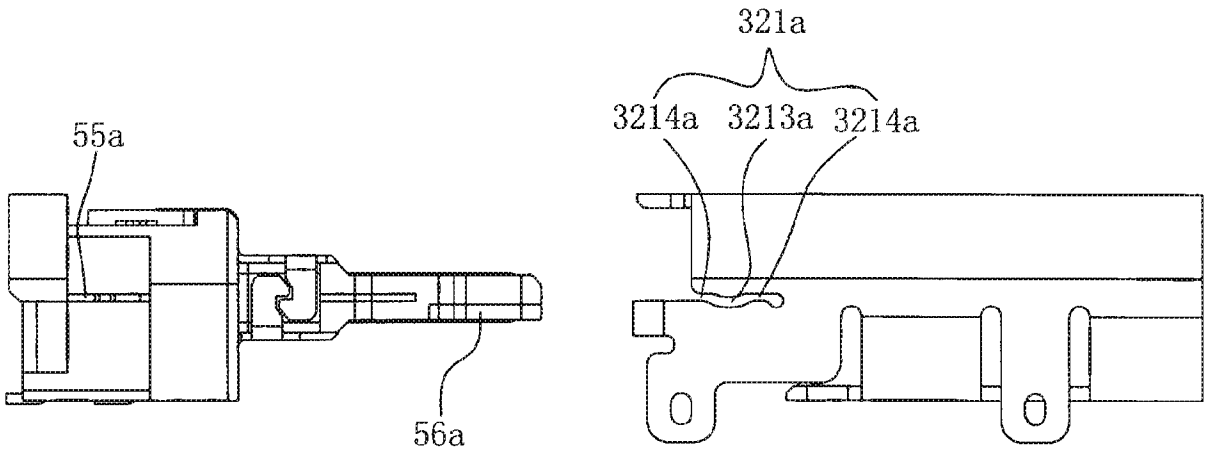
FIG. 11 is a side view illustrating the electrical connector of the second embodiment of the present disclosure with an outer shielding shell separated therefrom.
Figure 12:
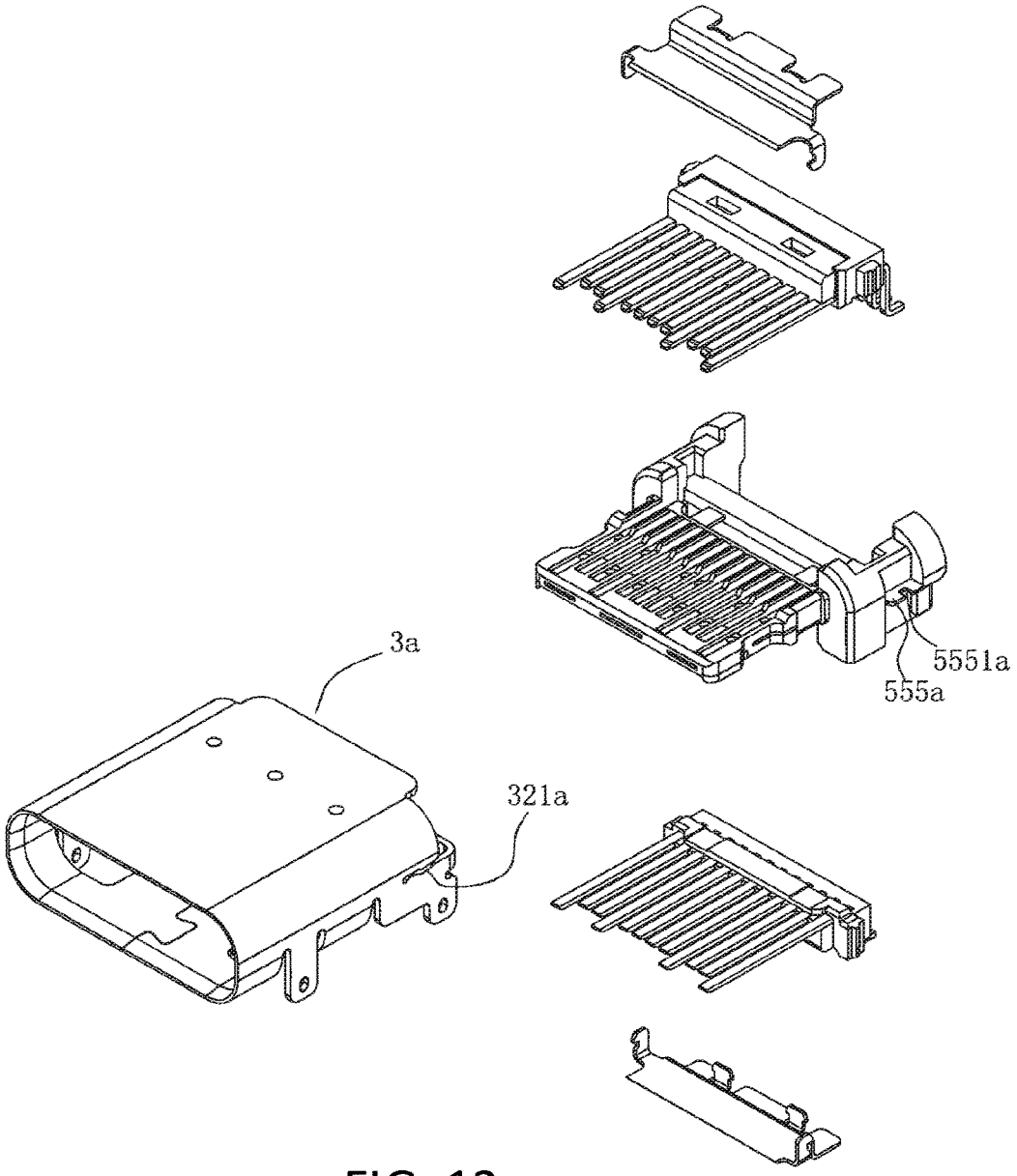
FIG. 12 is a view of the electrical connector of FIG. 11 with a first module, a second module and a third module separated from each other.
Figure 13:
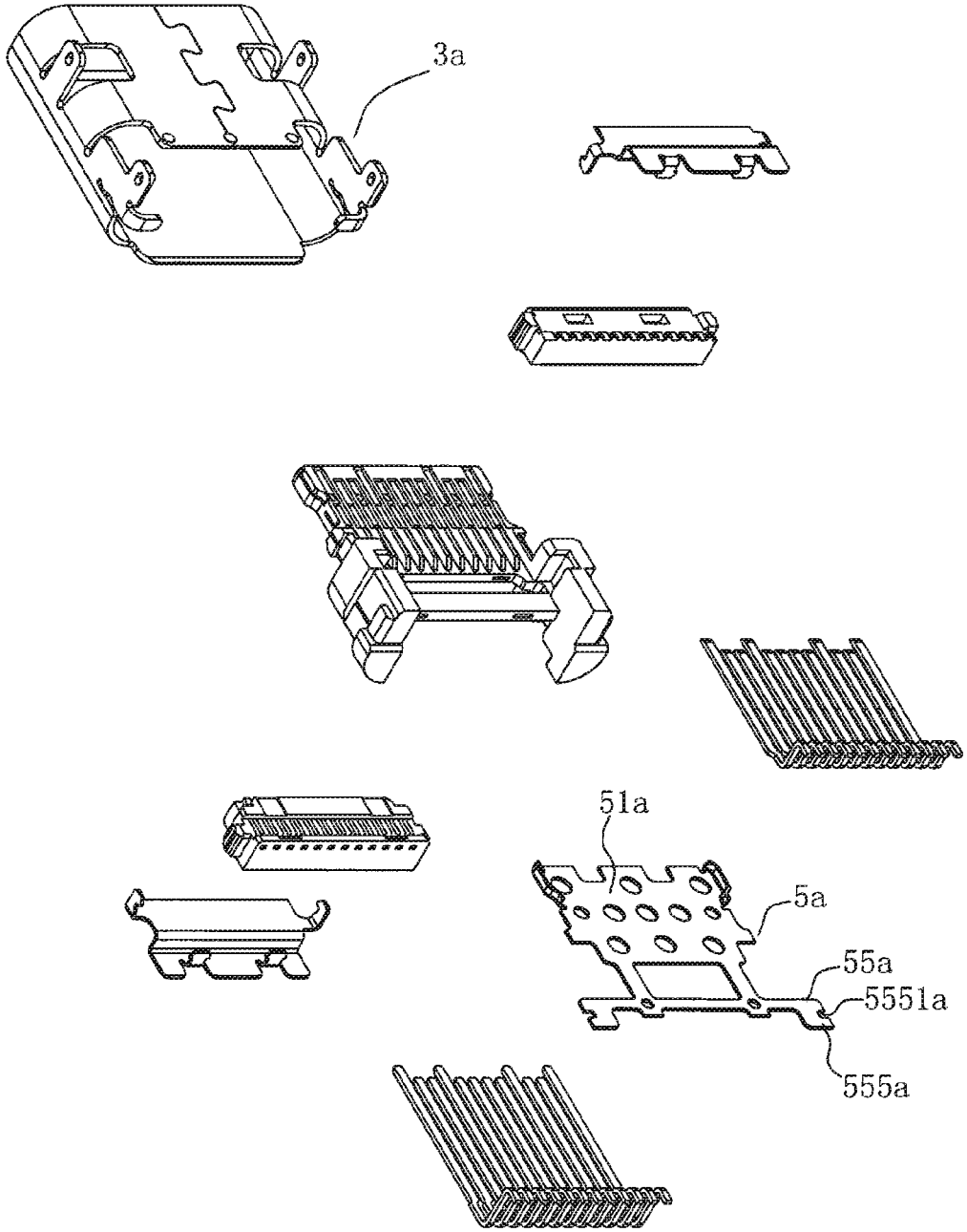
FIG. 13 is a view of FIG. 12 with conductive terminals, a grounding metal plate and an insulative body separated from each other.

Referring to FIG. 3 and FIG. 8, the grounding metal plate 5 comprises a main plate 51 and two connecting portions 53 extending rearwards from a rear edge of the main plate 51, a beam 54 transversally extending and connecting the two connecting portions 53, two extending portions 55 further extending outwards from two sides of the beam 54, and two protective portions 56 respectively extending from two sides of a front end of the main plate 51.

The beam 54 has an I-section shape, and is formed with two side wing portions 57 respectively at two ends thereof. A profile of the main plate 51 is similar to a profile of the front section of the tongue portion 16. The main plate 51 is embedded in the tongue portion 16 and spaces the first conductive terminals 21 apart from the second conductive terminals 22. The main plate 51 is partially exposed on the front surface 1671 and the two side surfaces 1672 of the tongue portion 16. It should be noted that, two side edges of the main plate 51 are respectively exposed on latching grooves 163, so as to contact plate springs on side surfaces of a mating plug (not shown) and in turn provide a grounding circuit for the grounding metal plate 5. The beam 54 is embedded in the main portion 15 of the third insulative member 13. Specifically, a main part of the beam 54 is embedded in the strengthening rib 155 of the main portion 15, the two side wing portions 57 are respectively embedded in the two extending side portions 152 of the main portion 15, so as to increase a structure strength of the main portion 15.

As shown in FIG. 3, the two extending portions 55 extend outwards from two sides of the main portion 15, a distal end of each extending portion 55 is formed as a contact portion 555, the contact portion 555 is correspondingly inserted into the fixing groove 321 of the outer shielding shell 3 and is locked at a position of the fixing groove 321 where the bottom edge 3211 and the incline edge 3212 are jointed, so as to closely contact the outer shielding shell 3 and in turn allow the grounding metal plate 5 and the outer shielding shell 3 to be electrically connected, so that each contact portion 555 can provide a grounding circuit for the grounding metal plate 5 via the grounding soldering legs 35, 37 of the outer shielding shell 3. In the present embodiment, specifically, the contact portion 555 is a rectangular piece protruding outwards. In comparison with the prior art, such a grounding structure is realized as that the contact portion 555 and the fixing groove 321 of the outer shielding shell 3 are closely engaged in a manner of clipping, contact may be more reliable and in turn may easily obtain a good grounding effect, and it is easy to observe contact status of the contact portion 555 and the fixing groove 321 so as to facilitate modification on the contact status of the contact portion 555 and the fixing groove 321. In addition, such a grounding structure does not require a grounding soldering leg (not shown) to be additionally provided on the grounding metal plate 5 and a corresponding grounding soldering pad to be additionally provided on the circuit board 20, which is simple and convenient for implementation.

Each protective portion 56 is bent and extends perpendicular to the main plate 51. Specifically, each protective portion 56 comprises a latching surface 562 exposed on a fixing groove 17, a guiding surface 564 exposed on a transitional position between the front surface 1671 and the two side surfaces 1672 of the tongue portion 16, and a connecting surface 563 connected between the latching surface 562 and the guiding surface 564. In the present embodiment, the latching surface 562, the connecting surface 563 and the guiding surface 564 are positioned at an outer side of a cantilever 561 connected to the side edge of the main plate 51. The two protective portions 56 may prevent a front edge of the tongue portion 16 from being damaged when the tongue portion 16 mates with the mating connector repeatedly. In addition, because the latching surface 562 is correspondingly exposed on the latching groove 163 of the insulative body 1, the latching surface 562 can abut against the plate spring (not shown) on the side surface of the mating connector so that another grounding circuit is provided for the grounding metal plate 5.

In addition, the main plate 51 is formed with a plurality of through holes 58 thereon. A joint position between the beam 54 and the connecting portion 53 is also formed with two through holes 59. These through holes 58, 59 may increase an engaging strength between the third insulative member 13 and the grounding metal plate 5.

Figure 7:
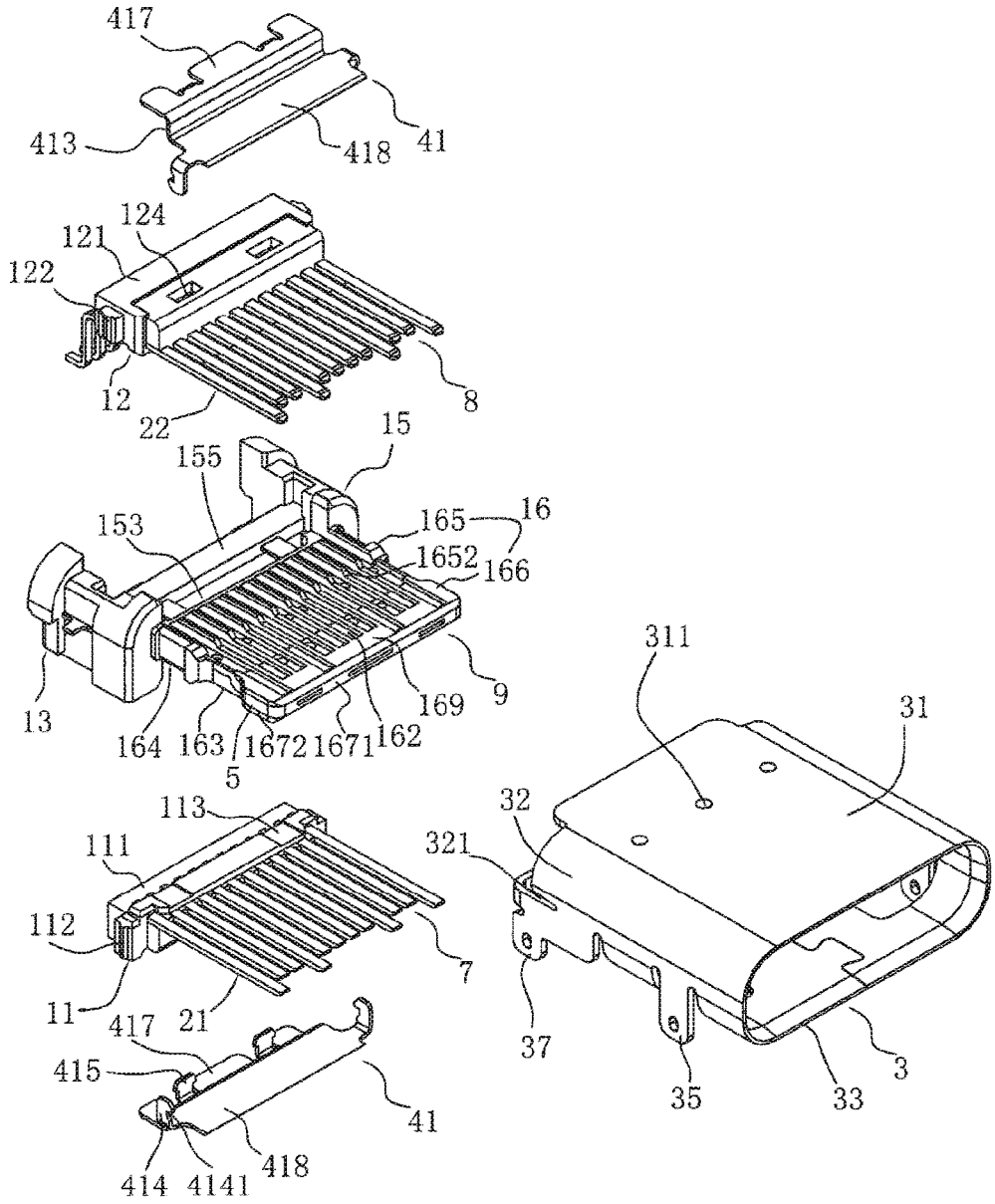
FIG. 7 is a view of FIG. 5 with a first module, a second module and a third module separated from each other.

Referring to FIG. 7 and FIG. 8, the first conductive terminals 21 and the first insulative member 11 are engaged as a first module 7. The second conductive terminals 22 and the second insulative member 12 are engaged as a second module 8. The grounding metal plate 5 and the third insulative member 13 are engaged as a third module 9. Here, the first module 7 is stacked on the third module 9 from down to up, so that the mating portion 211 of the first conductive terminal 21 is correspondingly inserted into and received in the first terminal receiving groove 161 of the tongue portion 16; the second module 8 is stacked on the third module 9 from up to down, so that the mating portion 221 of the second conductive terminal 22 is correspondingly inserted into and received in the second terminal receiving groove 162 of the tongue portion 16.

An assembling process of the electrical connector of the first embodiment of the present disclosure generally comprises steps of: forming the conductive terminals 2, the outer shielding shell 3, the two metal shell members 41 and the grounding metal plate 5 by punching and bending; then forming the first module 7, the second module 8 and the third module 9 by insert molding; next inserting the first module 7 into the lower part of the receiving space 153 of the third module 9 from down to up, then inserting the second module 8 into the upper part of the receiving space 153 of the third module 9 from up to down, until the bottom surface of the second insulative member 12 and the top surface of the first insulative member 11 abut against each other, so that the first module 7 is provided on the third module 9 and the third module 9 is closely interposed between the first module 7 and the second module 8 so as to form a combined body 6; next, correspondingly mounting the two metal shell members 41 onto the combined body 6; finally sheathing the outer shielding shell 3 onto the insulative body 1 from front to rear.

In comparison with the prior art, the electrical connector 10 of the first embodiment of the present disclosure may reliably provide a grounding circuit for the grounding metal plate 5 by allowing the extending portion 55 of the grounding metal plate 5 to contact the outer shielding shell 3 and then to be grounded via the grounding soldering legs 35, 37 of the outer shielding shell 3, thereby facilitating transmission of high frequency signals, so that interference between high frequency signals of the two groups of conductive terminals 21, 22 may be reduced; in addition, the protective portion 56 of the grounding metal plate 5 contacts the plate spring of the mating connector, it may increase a grounding circuit; also, such a structure does not require a grounding soldering pad to be additionally provided on the circuit board 20.

Referring to FIG. 9 to FIG. 13, an electrical connector of a second embodiment of the present disclosure is illustrated. Main differences between an electrical connector 10*a* and the electrical connector 10 of the previous embodiment lie in that a fixing groove 321*a* of an outer shielding shell 3*a* is different from the fixing groove 321 of the outer shielding shell 3 in shape, an extending portion 55*a* of a grounding metal plate 5*a* is also different from the extending portion 55 of the grounding metal plate 3 in shape. Specifically, in the present embodiment, the fixing groove 321*a* has a plurality of arc edges, the arc edges allow the fixing groove 321*a* to form a wide section 3213*a* and two narrow sections 3214*a* respectively positioned at a front side and a rear side of the wide section 3213*a*; a contact portion 555*a* is a rectangular piece with a notch 5551*a* positioned in the middle of the contact portion 555*a* and opened outwards. When the extending portion 55*a* of the grounding metal plate 5*a* is locked on the outer shielding shell 3*a*, the notch 5551*a* of the contact portion 555*a* corresponds to the wide section 3213*a* of the fixing groove 321*a*, other portions 556*a* of the contact portion 555*a* are correspondingly locked at the narrow sections 3214*a* of the fixing groove 321*a*.

Figure 14:
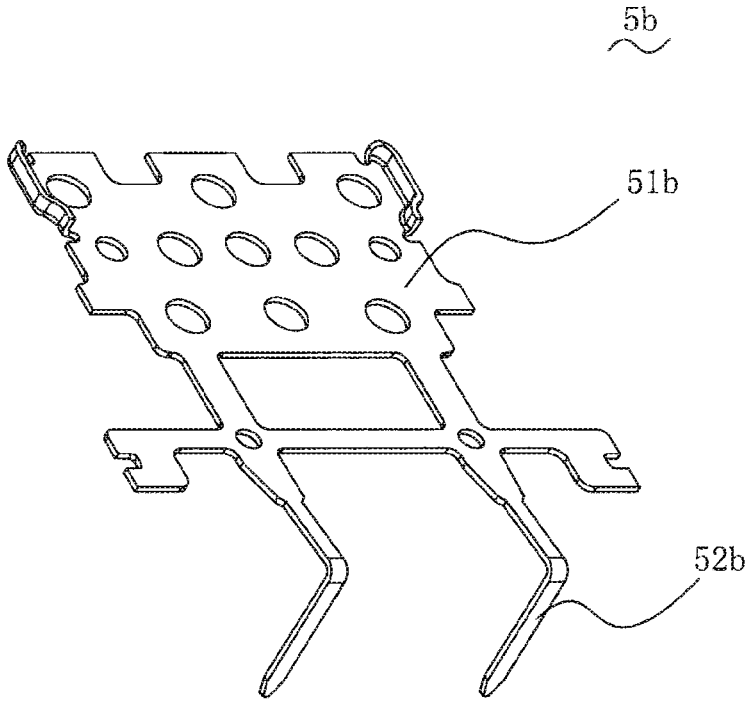
FIG. 14 is a view illustrating a grounding metal plate of an electrical connector of a third embodiment of the present disclosure.
Figure 15:
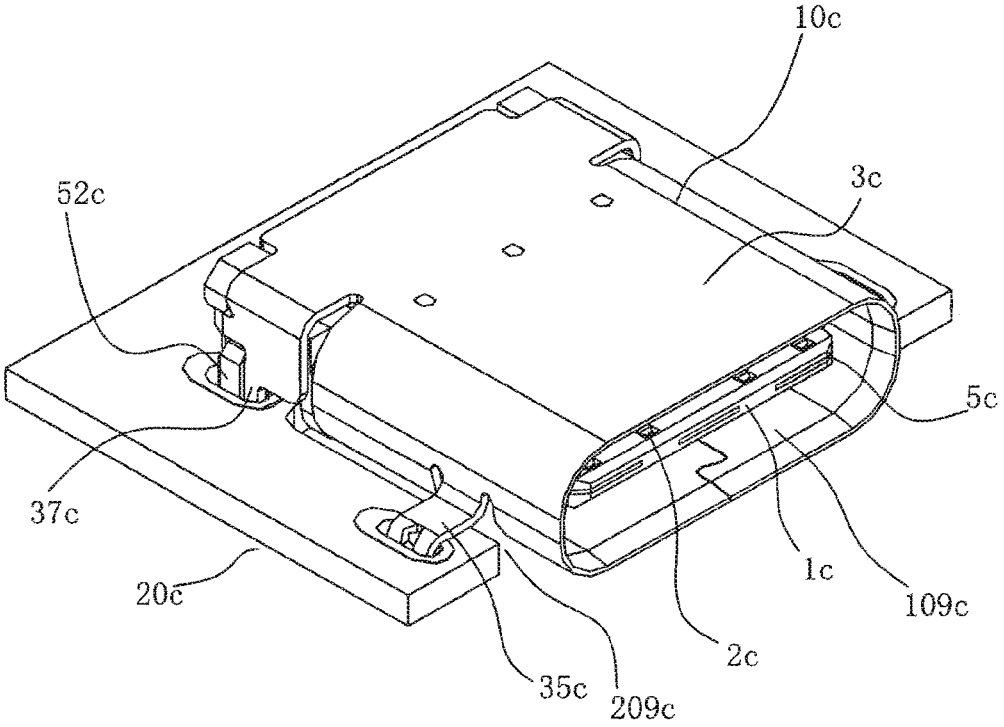
FIG. 15 is a view illustrating an electrical connector of a fourth embodiment of the present disclosure and a circuit board.

Referring to FIG. 14, a grounding metal plate of an electrical connector of a third embodiment of the present disclosure is illustrated, a difference among a grounding metal plate 5*b* and the previous grounding metal plates 5, 5*a* lies in that the grounding metal plate 5*b* may further comprise two grounding soldering legs 52*b* bent from a rear end of the main plate 51*b* and extending, the two grounding soldering legs 52*b* can be correspondingly soldered to a circuit board, so that an additional grounding circuit may be further provided for the grounding metal plate 5*b*.

Referring to FIG. 15 to FIG. 22, an electrical connector of a fourth embodiment of the present disclosure is illustrated.

Referring to FIG. 15 to FIG. 18, an electrical connector 10*c* is an electrical connecting receptacle supporting a high data transmission rate, the electrical connector 10*c* may be mounted on a circuit board 20*c* in a sinking type. The circuit board 20*c* is provided with a notch 209*c* in the front thereof. The circuit board 20*c* is provided with a group of first soldering pads 201*c* and a group of second soldering pads 202*c* which are staggered with each other along a transversal direction and arranged along a front-rear direction on a rear portion of the circuit board 20*c*. The circuit board 20*c* is further provided with two front grounding soldering pads 205*c* and two rear grounding soldering pads 207*c*. Here, the first soldering pads 201*c* and the second soldering pads 202*c* are in form of surface mount technology, the grounding soldering pads 205*c*, 207*c* are in form of penetrating. The electrical connector 10*c* generally comprises: an insulative body 1*c*, a plurality of conductive terminals 2*c* provided to the insulative body 1*c*, an outer shielding shell 3*c* sheathed and fixed around an outer periphery of the insulative body 1*c*, an inner shielding shell 4*c* fixed between the outer shielding shell 3*c* and the insulative body 1*c* and a grounding metal plate 5*c* embedded in the insulative body 1. The outer shielding shell 3*c* is enclosed to form a mating cavity 109*c* provided as symmetry of 180 degrees. The electrical connector 10*c* is received in the notch 209*c* of the circuit board 20*c* in form of sinking. The conductive terminals 2*c* can be soldered onto the two groups of soldering pads 201*c*, 202*c* of the circuit board 20*c* by surface mount technology. The outer shielding shell 3*c* has a plurality of grounding soldering legs 35*c*, 37*c*, the grounding soldering legs 35, 37 may be soldered to the grounding soldering pads 205*c*, 207*c* of the circuit board 20*c*, respectively.

Referring to FIG. 19 to FIG. 22, the insulative body 1*c* comprises a body portion 14*c* and a tongue portion 16*c* extending forwards from the body portion 14*c*. Here, the body portion 14*c* is relatively wide and large and the tongue portion 16*c* is relatively narrow and long. Specifically, the insulative body 1*c* is formed by assembling a first insulative member 11*c*, a second insulative member 12*c* and a third insulative member 13*c*.

The first insulative member 11*c* mainly comprises a base portion 111*c* with a rectangular parallelepiped shape, two fixed portions 112*c* respectively provided on two opposite sides of the base portion 111*c* and extending vertically, two receiving channels 113*c* provided on a top side of the base portion 111*c*, and two fixing grooves 114*c* provided on the base portion 111*c*. Specifically, each fixed portion 112*c* is a protruding rail extending vertically.

The second insulative member 12*c* mainly comprises a base portion 121*c* with a rectangular parallelepiped shape, two fixed portions 122*c* respectively provided on two opposite sides of the base portion 121*c* and extending vertically, two receiving channels (not shown) provided on a bottom side of the base portion 121*c*, and two fixing grooves 124*c* provided on the base portion 121*c*. Specifically, each fixed portion 122*c* is a protruding rail extending vertically.

The third insulative member 13*c* mainly comprises a main portion 15*c* and a tongue portion 16*c* extending forwards from a front side of the main portion 15*c*. The main portion 15*c* generally comprises two opposite extending side portions 152*c* and a strengthening rib 155*c* transversely connected between the two extending side portions 152*c*. The main portion 15*c* is formed with a receiving space 153*c* penetrating along an up-down direction. The first insulative member 11*c* and the second insulative member 12*c* are respectively fixed at a lower part and an upper part of the receiving space 153*c* and abut against each other. The tongue portion 16*c* further extends forwards from a front end of the two extending side portions 152*c*. Two opposite inner sides of the lower parts of the two extending side portions 152*c* each are provided with a first mounting portion. Two opposite inner sides of the upper parts of the two extending side portions 152*c* each are provided with a second mounting portion 1522*c*. Specifically, the first mounting portion is a first channel extending vertically and recessed on the inner side of the lower part of the extending side portion 152*c*, the first channel is opened at a lower end of the extending side portion 152*c*. The second mounting portion 1522*c* is a second channel extending vertically and recessed on the inner side of the upper part of the extending side portion 152*c*, the second channel is opened at an upper end of the extending side portion 152*c*. The extending side portion 152*c* is further formed with a position limit block 1526*c* protruding upwards at a rear end of a top surface of the extending side portion 152*c*. The strengthening rib 155*c* is provided with a group of terminal receiving grooves 1551*c* on a top surface thereof for receiving and fixing connecting portions 223*c* of the second conductive terminals 22*c* so as to prevent the second conductive terminals 22*c* from being deformed.

The tongue portion 16*c* has a first surface (a lower side surface) 168*c* and a second surface (an upper side surface) 169*c* which are opposite along the up-down direction and a front surface 1671*c* and two side surfaces 1672*c* connected between the first surface 168*c* and the second surface 169*c*.

The first surface 168*c* of the tongue portion 16*c* is formed with a group of first terminal receiving grooves 161*c* thereon. The second surface 169*c* of the tongue portion 16*c* is formed with a group of second terminal receiving grooves 162*c* thereon. The tongue portion 16*c* comprises a rear section 165*c* close to the body portion 14*c* and a front section 166*c* extending forwards from the rear section 165*c*. Two sides of the front section 166*c* of the tongue portion 16*c* each are formed with a recessed latching groove 163*c*. Two sides of the rear section 165*c* of the tongue portion 16*c* each are formed with a receiving groove 164*c*. A plurality of protruding ribs 1651*c* and a plurality of protruding ribs 1652*c* protrude respectively from a part of the first surface 168*c* and a part of the second surface 169*c* at the rear section 165*c* along a direction perpendicular to an extending direction of the tongue portion 16*c*, a section of the terminal receiving groove 161*c* is formed between the two protruding ribs 1651*c* and a section of the terminal receiving groove 162*c* is formed between the two protruding ribs 1652*c*. Top surfaces of the protruding ribs 1651*c* are substantially flushed with each other, top surfaces of the protruding ribs 1652*c* are substantially flushed with each other, a distance between the top surface of the side protruding rib 1651*c* of the tongue portion 16*c* and the top surface of the side protruding rib 1652*c* of the tongue portion 16*c* which are positioned respectively at an upper side and a lower side of the tongue portion 16*c* defines a thickness of the rear section 165*c*. The thickness of the rear section 165*c* is larger than a thickness of the front section 166*c*. Such a structure may allow the tongue portion 16*c* to have a good strength so as to avoid damage from a mating connector.

Specifically, the two fixed portions 112*c* of the first insulative member 11*c* and the two first mounting portions of the third insulative member 13*c* are correspondingly engaged, so that the first insulative member 11*c* is inserted from down to up, mounted and fixed in the lower part of the receiving space 153*c*. The two fixed portions 122*c* of the second insulative member 12*c* and the two second mounting portions 1522*c* of the third insulative member 13*c* are correspondingly engaged, so that the second insulative member 12*c* is inserted from up to down, mounted and fixed in the upper part of the receiving space 153*c*, a bottom surface of the base portion 121*c* of the second insulative member 12*c* and a top surface of the base portion 111*c* of the first insulative member 11*c* abut against each other. Such an engaged structure may allow the first insulative member 11*c*, the second insulative member 12*c* and the third insulative member 13*c* to be compactly engaged together to constitute the body portion 14*c* of the insulative body 1*c* (referring to FIG. 17).

Figure 16:
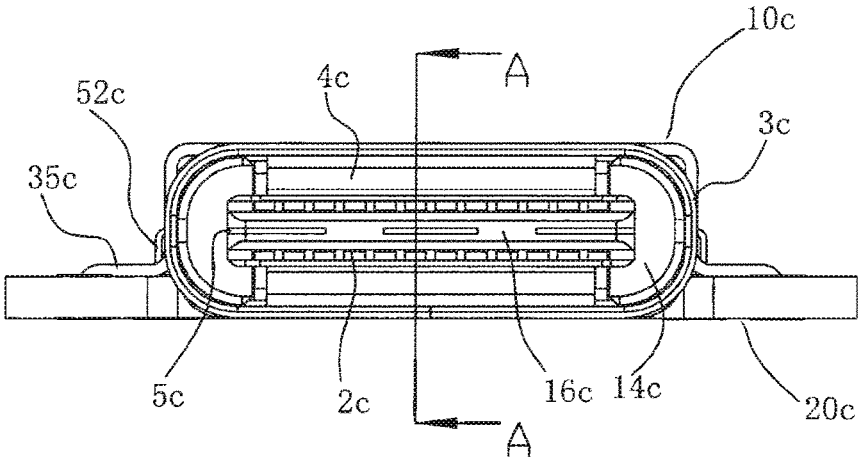
FIG. 16 is a front view of the electrical connector and the circuit board of FIG. 15.
Figure 17:
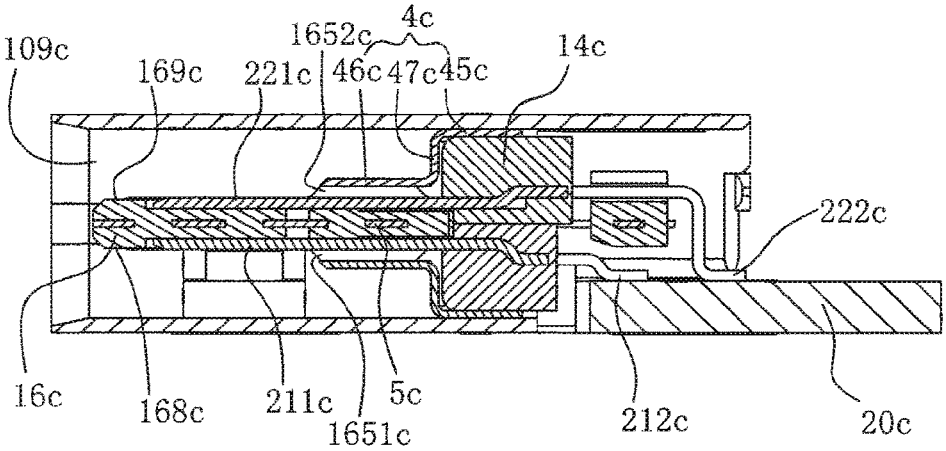
FIG. 17 is a cross sectional view taken along a line A-A of FIG. 16.
Figure 18:
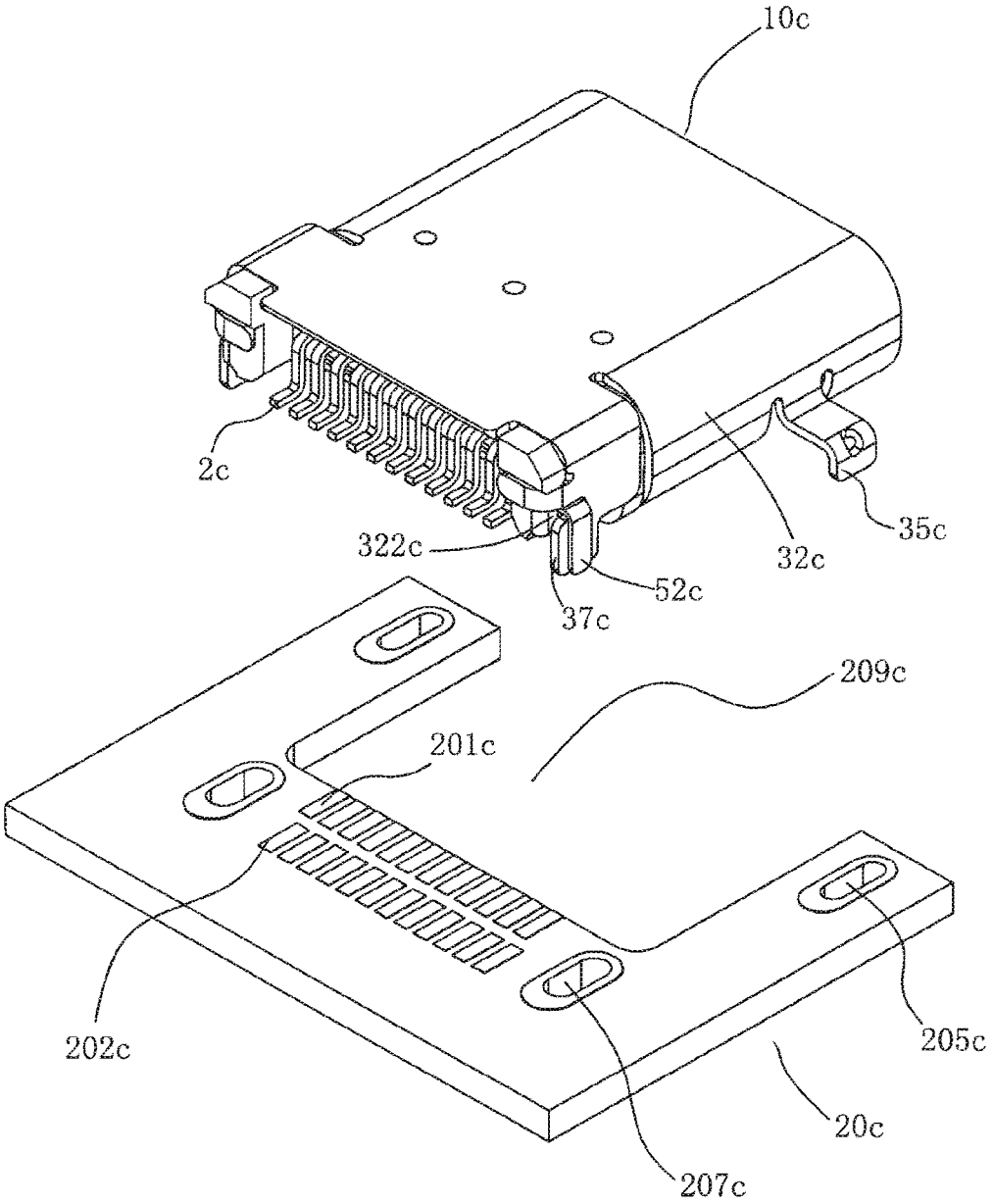
FIG. 18 is a view of FIG. 15 with the circuit board separated.
Figure 19:
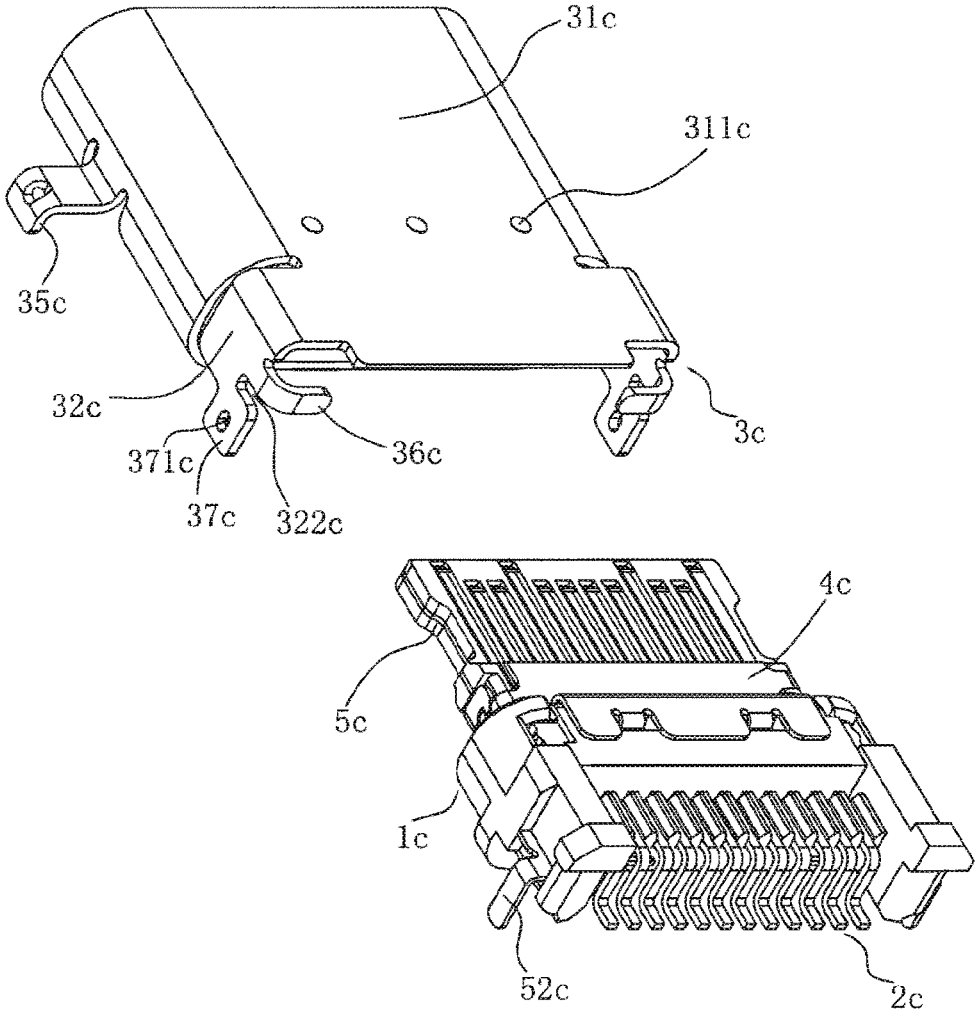
FIG. 19 is a view of the electrical connector of the present disclosure with an outer shielding shell separated therefrom.

Referring to FIG. 19 to FIG. 22, the conductive terminals 2*c* are integrally formed by punching and bending from a metal plate. The conductive terminals 2*c* are divided into a group of first conductive terminals 21*c* and a group of second conductive terminals 22*c*. Each first conductive terminal 21*c* comprises a mating portion 211*c*, a soldering portion 212*c* and a connecting portion 213*c* connected between the mating portion 211*c* and the soldering portion 212*c*. The mating portion 211*c* is correspondingly received in the first terminal receiving groove 161*c* and is exposed on the first surface 168*c* of the tongue portion 16*c*. The soldering portion 212*c* extends rearwards out of the body portion 14*c* of the insulative body 1*c*. The connecting portion 213*c* is embedded in the body portion 14*c*. Similarly, each second conductive terminal 22*c* comprises a mating portion 221*c*, a soldering portion 222*c* and a connecting portion 223*c* connected between the mating portion 221*c* and the soldering portion 222*c*. The mating portion 221*c* is correspondingly received in the second terminal receiving groove 162*c* and is exposed on the second surface 169*c* of the tongue portion 16*c*. The soldering portion 222*c* extends rearwards out of the body portion 14*c* of the insulative body 1*c*. The connecting portion 223*c* is embedded in the body portion 14*c*. Tail portions of the connecting portion 223*c* are respectively received in the terminal receiving grooves 1551*c* of the strengthening rib 155*c* of the main portion 15*c*. Referring to FIG. 16, the mating portions 211*c* of the first conductive terminals 21*c* and the mating portions 221*c* of the second conductive terminals 22*c* are arranged as symmetry of 180 degrees in the mating cavity 109*c*, so that a proper connection can be obtained when the mating connector is inserted into the electrical connector 10*c* with a proper orientation or with an upside down orientation.

Referring to FIG. 18 to FIG. 22, the outer shielding shell 3*c* comprises a top wall 31*c*, two side walls 32*c* and a bottom wall 33*c*. The front grounding soldering leg 35*c* extends downwards from a middle position of each side wall 32*c*. A rear portion of each side wall 32*c* is formed with the rear grounding soldering leg 37*c* extending downwards therefrom. The rear grounding soldering leg 37*c* is provided with a grabbing solder hole 371*c* thereon so as to increase the engaging strength between the rear grounding soldering leg 37*c* and the circuit board 20*c*. The rear portion of each side wall 32*c* is further formed with a latching piece 36*c*. Each side wall 32*c* is opened with a slender receiving groove 322*c* above the rear grounding soldering leg 37*c*. The receiving groove 322*c* is positioned below the latching piece 36*c* and has an opening opened rearwards. When the outer shielding shell 3*c* is sheathed onto the insulative body 1*c*, a rear end of the side wall 32*c* will abut against the position limit block 1526*c* of the insulative body 1*c*, the latching piece 36*c* latches on to a rear side of the insulative body 1*c* after the latching piece 36*c* is bent, so as to allow the outer shielding shell 3*c* to be fixed on the insulative body 1*c*.

Referring to FIG. 17 and FIG. 19 to FIG. 22, the inner shielding shell 4*c* is fixed around the outer periphery of the body portion 14*c*, and is attached on and surrounds a rear section 165*c* of the tongue portion 16*c*, and extends with a distance. Specifically, the inner shielding shell 4*c* comprises a fixed section 45*c* positioned in the rear thereof and attached on a front section of the body portion 14*c*, an extending section 46*c* positioned in the front thereof and attached on the rear section 165*c* of the tongue portion 16*c*, and a connecting section 47*c* vertically connected between the fixed section 45*c* and the extending section 46*c*. The inner shielding shell 4*c* may be grounded by that the fixed section 45*c* contacts the outer shielding shell 3*c*. Because the extending section 46*c* is supported on the protruding ribs 1651*c* and the protruding ribs 1652*c*, an interval between one extending section 46*c* and the first conductive terminals 21*c* and an interval between the extending section 46*c* and the second conductive terminals 22*c* may be maintained.

Specifically, the inner shielding shell 4*c* is formed by engaging two metal shell members 41*c* along the up-down direction. Each metal shell member 41*c* has a step profile, and comprises a horizontal fixed plate 417*c* fixed on the body portion 14*c*, a horizontal extending plate 418*c* attached on the rear section 165*c* of the tongue portion 16*c*, and a vertical connecting plate 413*c* vertically connected between the horizontal fixed plate 417*c* and the horizontal extending plate 418*c*. Two fixed protruding pieces 415*c* vertically extend from a rear edge of the horizontal fixed plate 417*c*, the fixed protruding piece 415*c* preferably is a barb. Two latching hooks 414*c*, 416*c* vertically extend respectively from two sides of the horizontal extending plate 418*c*, a latching notch 4141*c* of the latching hook 414*c* is opposite to a latching notch 4161*c* of the latching hook 416*c* in opening direction.

The fixed protruding piece 415*c* of the metal shell member 41*c* positioned below is correspondingly inserted into the fixing groove 114*c* of the first insulative member 11*c*. The fixed protruding piece 415*c* of the metal shell member 41*c* positioned above is correspondingly inserted into the fixing groove 124*c* of the second insulative member 12*c*. In addition, the latching hook 414*c* of one metal shell member 41*c* latches on to the latching hook 416*c* of the other metal shell member 41*c*, so that the two metal shell members 41*c* may be locked with each other. Specifically, the latching hooks 414*c*, 416*c* are latched on to each other in the receiving groove 164*c* of the insulative body 1*c*, so as to surround the rear section 165*c* of the tongue portion 16*c* therein.

The inner shielding shell 4*c* may be grounded by that the inner shielding shell 4*c* is engaged with engaging portions 311*c*, 331*c* of the outer shielding shell 3*c* via laser welding or elastic contact.

Figure 22:
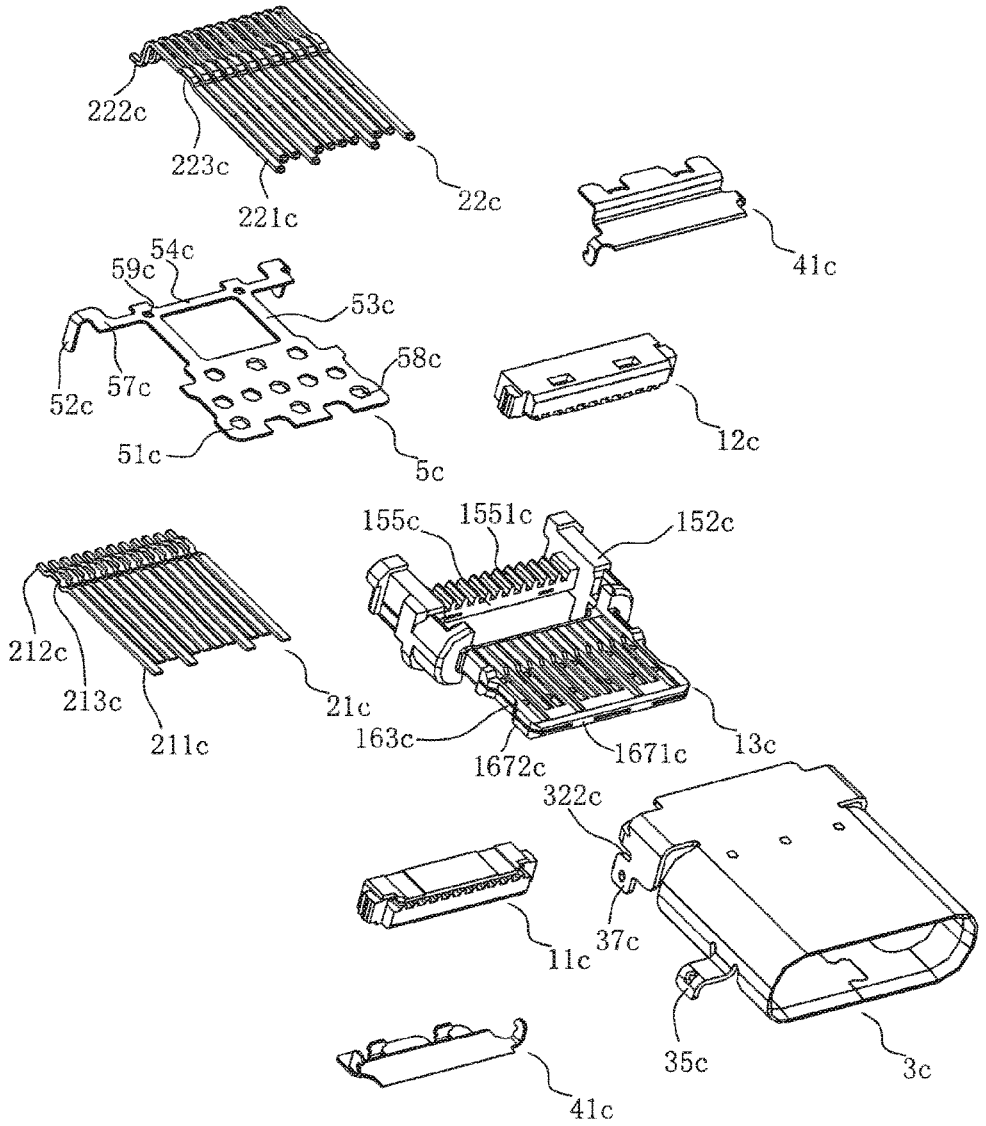
FIG. 22 is a view of FIG. 21 with conductive terminals, a grounding metal plate and an insulative body separated from each other.

Referring to FIG. 22, the grounding metal plate 5*c* is integrally formed by punching and bending. The grounding metal plate 5*c* comprises a main plate 51*c* and two connecting portions 53*c* extending rearwards from a rear edge of the main plate 51*c*, a beam 54*c* transversally extending and connecting the two connecting portions 53*c*, and two grounding soldering legs 52*c* further extending outwards from two sides of the beam 54*c*.

Specifically, the two connecting portions 53*c* are constituted by two extending arms which are spaced apart from each other and extend rearwards from the rear edge of the main plate 51*c*. The beam 54*c* has an I-section shape, and is formed with two side wing portions 57*c* respectively at two ends thereof. A profile of the main plate 51*c* is substantially the same as a profile of the front section of the tongue portion 16*c*. The main plate 51*c* is embedded in the tongue portion 16*c* and spaces the first conductive terminals 21*c* apart from the second conductive terminals 22*c*. The main plate 51*c* is partially exposed on the front surface 1671*c* and the two side surfaces 1672*c* of the tongue portion 16*c*. It should be noted that, two side edges of the main plate 51*c* are respectively exposed on latching grooves 163*c*, so as to contact plate springs on side surfaces of a mating plug (not shown) and in turn provide a grounding circuit for the grounding metal plate 5*c*. The beam 54*c* is embedded in the main portion 15*c* of the third insulative member 13*c* and extends outwards from two sides of the main portion 15*c*. Specifically, a main part of the beam 54*c* is embedded in the strengthening rib 155*c* of the main portion 15*c*, the two side wing portions 57*c* are respectively embedded in the two extending side portions 152*c* of the main portion 15*c*, so as to increase a structure strength of the main portion 15*c*.

The two grounding soldering legs 52*c* are bent downwards respectively from two ends of the beam 54*c* and extend. The two grounding soldering legs 52*c* extend outwards respectively from two sides of the body portion 14*c* of the insulative body 1*c* and respectively attach on the grounding soldering legs 37*c* of the outer shielding shell 3*c*. Specifically, each grounding soldering leg 52*c* horizontally passes through the receiving groove 322*c* of the outer shielding shell 3*c*, attaches on the grounding soldering leg 37*c* from the outside of the grounding soldering leg 37*c*, and extends downwards, so that each grounding soldering leg 52*c* can share one grounding soldering pad 207*c* of the circuit board 20*c* with the rear grounding soldering leg 37*c* (referring to FIG. 15 and FIG. 18) to be grounded. That the grounding soldering leg 52*c* contacts the outer shielding shell 3*c* is further beneficial to further increase the grounding effect for the grounding metal plate 5*c*.

In addition, the main plate 51*c* is formed with a plurality of through holes 58*c* thereon. Preferably, the through holes 58*c* are arranged as symmetry with respect to a central axis extending along the front-rear direction. A joint position between the beam 54*c* and the connecting portion 53*c* is also formed with two through holes 59*c*. These through holes 58*c*, 59*c* may increase an engaging strength between the third insulative member 13*c* and the grounding metal plate 5*c*.

Figure 20:
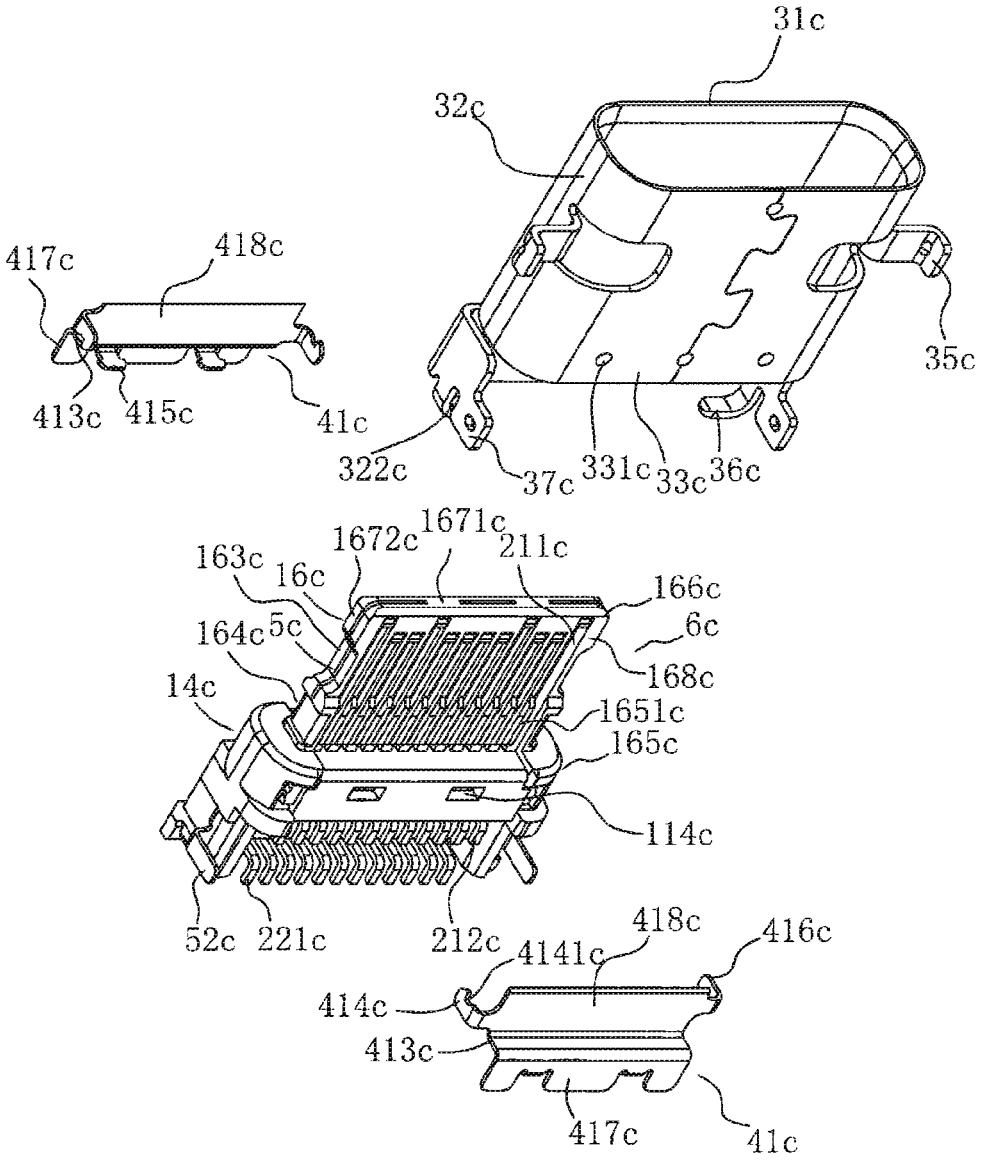
FIG. 20 is a view of the electrical connector of FIG. 19 with an inner shielding shell separated therefrom.
Figure 21:
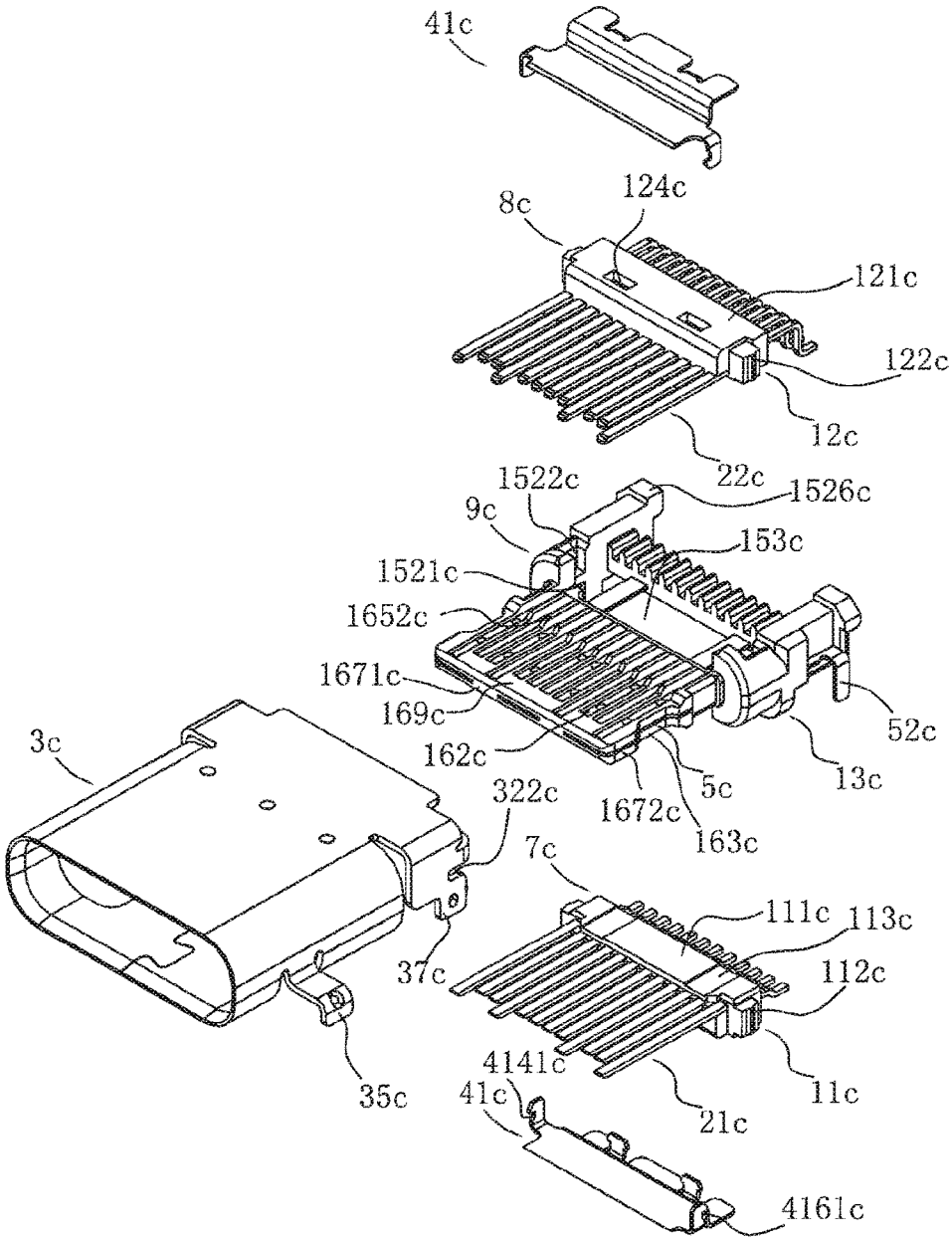
FIG. 21 is a view of FIG. 20 with a first module, a second module and a third module separated from each other.

Referring to FIG. 20 to FIG. 22, the first conductive terminals 21*c* are embedded into the first insulative member 11*c* by insert molding process so that the first conductive terminals 21*c* and the first insulative member 11*c* are engaged as a first module 7*c*. The second conductive terminals 22*c* are embedded into the second insulative member 12*c* by insert molding process so that the second conductive terminals 22*c* and the second insulative member 12*c* are engaged as a second module 8*c*. The grounding metal plate 5*c* is embedded into the third insulative member 13*c* by insert molding process so that the grounding metal plate 5*c* and the third insulative member 13*c* are engaged as a third module 9*c*. Here, the first module 7*c* is stacked on the third module 9*c* from down to up, so that the mating portion 211*c* of the first conductive terminal 21*c* is correspondingly inserted into and received in the first terminal receiving groove 161*c* of the tongue portion 16*c*; the second module 8*c* is stacked on the third module 9*c* from up to down, so that the mating portion 221*c* of the second conductive terminal 22*c* is correspondingly inserted into and received in the second terminal receiving groove 162*c* of the tongue portion 16*c*. Such a combined structure facilitates manufacturing and assembling.

An assembling process of the electrical connector of the fourth embodiment of the present disclosure generally comprises steps of: forming the conductive terminals 2*c*, the outer shielding shell 3*c*, the two metal shell members 41*c* and the grounding metal plate 5*c* by punching and bending; then forming the first module 7*c*, the second module 8*c* and the third module 9*c* by insert molding; next inserting the first module 7*c* into the lower part of the receiving space 153*c* of the third module 9*c* from down to up, then inserting the second module 8*c* into the upper part of the receiving space 153*c* of the third module 9*c* from up to down, until the bottom surface of the second insulative member 12*c* and the top surface of the first insulative member 11*c* abut against each other, so that the first module 7*c* is provided on the third module 9*c* and the third module 9*c* is closely interposed between the first module 7*c* and the second module 8*c* so as to form a combined body 6*c*; next, correspondingly mounting the two metal shell members 41*c* onto the combined body 6*c*; finally sheathing the outer shielding shell 3*c* onto the insulative body 1*c* from front to rear.

In comparison with the prior art, in the electrical connector 10*c* of the fourth embodiment of the present disclosure, the grounding soldering leg 52*c* of the grounding metal plate 5*c* attaches on the rear grounding soldering leg 37*c* of the outer shielding shell 3*c*, so that the grounding soldering leg 52*c* can share one grounding soldering pad 207*c* of the circuit board 20*c* provided for the rear grounding soldering leg 37*c* of the outer shielding shell 10*c*, the grounding soldering leg 52*c* of the grounding metal plate 5*c* does not require a grounding soldering pad additionally provided on the circuit board 20*c*, and also may allow the grounding metal plate 5*c* to obtain a reliable grounding effect.

The above contents are only embodiments of the present disclosure and are not used to limit the implementing solution of the present disclosure, those skilled in the art may conveniently make corresponding variation or modification based on the main concept and spirit of the present disclosure, therefore the extent of protection of the present disclosure shall be determined by terms of the Claims.

What is claimed is:

1. An electrical connector, comprising:

an insulative body comprising a body portion and a tongue portion extending forwards from the body portion, the tongue portion having a first surface and a second surface which are opposite along an up-down direction;

a plurality of conductive terminals divided into a group of first conductive terminals and a group of second conductive terminals, each conductive terminal comprising a mating portion extending forwards onto the tongue portion and a soldering portion extending out of the body portion, the mating portion of each first conductive terminal being exposed on the first surface of the tongue portion, the mating portion of each second conductive terminal being exposed on the second surface of the tongue portion;

an outer shielding shell fixed on the insulative body, having a grounding soldering leg and enclosing an outer space of the tongue portion to form a mating cavity; and a grounding metal plate comprising a main plate and an extending portion extending from the main plate, the main plate being embedded in the tongue portion and spacing the first conductive terminals apart from the second conductive terminals, the extending portion extending out from at least a side of the insulative body and electrically contacting the outer shielding shell, wherein the grounding metal plate further comprises two connecting portions extending rearwards from a rear edge of the main plate, a beam extending transversally and connected with the two connecting portions, the beam is embedded in the body portion of the insulative body, the two extending portions of the grounding metal plate being planar with the beam and further extend outwards from two sides of the beam respectively.

2. An electrical connector, comprising:

an insulative body comprising a body portion and a tongue portion extending forwards from the body portion, the tongue portion having a first surface and a second surface which are opposite along an up-down direction;

a plurality of conductive terminals divided into a group of first conductive terminals and a group of second conductive terminals, each conductive terminal comprising a mating portion extending forwards onto the tongue portion and a soldering portion extending out of the body portion, the mating portion of each first conductive terminal being exposed on the first surface of the tongue portion, the mating portion of each second conductive terminal being exposed on the second surface of the tongue portion;

an outer shielding shell fixed on the insulative body, having a grounding soldering leg and enclosing an outer space of the tongue portion to form a mating cavity; and a grounding metal plate comprising a main plate and an extending portion extending from the main plate, the main plate being embedded in the tongue portion and spacing the first conductive terminals apart from the second conductive terminals, the extending portion extending out from at least a side of the insulative body and electrically contacting the outer shielding shell, wherein a distal end of the extending portion is formed as a contact portion, and wherein the outer shielding shell is provided with a fixing groove corresponding to the extending portion so as to allow the contact portion to be inserted into the fixing groove.

3. The electrical connector according to claim 2, wherein the fixing groove has a bottom edge extending horizontally and an incline edge extending inclinely, the contact portion is locked at a position of the fixing groove where the bottom edge and the incline edge are jointed.

4. The electrical connector according to claim 2, wherein the fixing groove has an arc shape, the contact portion is locked in the fixing groove with the arc shape.

5. The electrical connector according to claim 4, wherein the fixing groove has a plurality of arc edges, the arc edges allow the fixing groove to form a wide section and two narrow sections respectively positioned at a front side and a rear side of the wide section, and wherein the contact portion is provided with a notch thereon, the notch correspondingly is locked at the wide section of the fixing groove, other portions of the contact portion are locked at the narrow sections of the fixing groove.

6. The electrical connector according to claim 2, wherein the outer shielding shell comprises a top wall, a bottom wall, two side walls and two fixing grooves, the bottom wall being opposite to the top wall, the two side walls being connected between the top wall and the bottom wall, each of the two side walls of the outer shielding shell is provided with one of the two fixing grooves respectively, and wherein the grounding metal plate comprises two extending portions, each extending portion protrudes outwards from a side of the body portion of the insulative body and correspondingly latches on to the fixing grooves of the outer shielding shell.

7. The electrical connector according to claim 2, wherein the grounding metal plate further comprises two connecting portions extending rearwards from a rear edge of the main plate, a beam extending transversally and connected with the two connecting portions, the beam is embedded in the body portion of the insulative body, the two extending portions of the grounding metal plate further extend outwards from two sides of the beam respectively.

8. The electrical connector according to claim 2, wherein the tongue portion further comprises a front surface and two side surfaces which are positioned between the first surface and the second surface, and wherein the grounding metal plate further comprises two protective portions extending respectively from two sides of a front end of the main plate, each protective portion at least comprises a guiding surface exposed on a transitional position between the front surface and the side surfaces of the tongue portion.

9. The electrical connector according to claim 2, wherein the electrical connector further comprises an inner shielding shell, the inner shielding shell is positioned between the outer shielding shell and the insulative body, and surrounds a rear section of the tongue portion of the insulative body and a part of the body portion adjacent to the tongue portion.

10. The electrical connector according to claim 2, wherein the grounding metal plate further comprises at least a grounding soldering leg bent from a rear end of the main plate and extending.

11. The electrical connector according to claim 2, wherein the first conductive terminals, the second conductive terminals and the grounding metal plate are embedded in a first insulative member, a second insulative member and a third insulative member, respectively, and wherein the first insulative member is provided on the third insulative member, the first insulative member and the second insulative member interpose the third insulative member therebetween.

12. The electrical connector according to claim 11, wherein the third insulative member is provided with the tongue portion thereon, the first surface of the tongue portion is formed with a group of first terminal receiving grooves thereon, the second surface of the tongue portion is formed with a group of second terminal receiving grooves thereon, and wherein the mating portions of the first conductive terminals are correspondingly received in the first terminal receiving grooves, the mating portions of the second conductive terminals are correspondingly received in the second terminal receiving grooves.

13. The electrical connector according to claim 12, wherein a rear portion of the third insulative member is provided with a plurality of terminal receiving grooves for correspondingly receiving the second conductive terminals.

14. An electrical connector, comprising:

an insulative body comprising a body portion and a tongue portion extending forwards from the body portion, the tongue portion having a first surface and a second surface which are opposite along an up-down direction;

a plurality of conductive terminals divided into a group of first conductive terminals and a group of second conductive terminals, each conductive terminal comprising a mating portion extending forwards onto the tongue portion and a soldering portion extending out of the body portion, the mating portion of each first conductive terminal being exposed on the first surface of the tongue portion, the mating portion of each second conductive terminal being exposed on the second surface of the tongue portion;

an outer shielding shell fixed on the insulative body, having a grounding soldering leg and enclosing an outer space of the tongue portion to form a mating cavity; and a grounding metal plate comprising a main plate and an extending portion extending from the main plate, the main plate being embedded in the tongue portion and spacing the first conductive terminals apart from the second conductive terminals, the extending portion extending out from at least a side of the insulative body and electrically contacting the outer shielding shell, wherein the extending portion of the grounding metal plate is a grounding soldering leg, the grounding soldering leg of the grounding metal plate closely attaches on the grounding soldering leg of the outer shielding shell.

15. The electrical connector according to claim 14, wherein the outer shielding shell has two grounding soldering legs extending downwards respectively from two sides of the outer shielding shell, and wherein the grounding metal plate comprises two grounding soldering legs respectively extending from two sides of the main plate.

16. The electrical connector according to claim 7, wherein the outer shielding shell is provided with two receiving grooves respectively above the grounding soldering legs of the outer shielding shell, the grounding soldering leg of the grounding metal plate correspondingly passes through the receiving groove and then attaches on the grounding soldering leg of the outer shielding shell from the outside of the grounding soldering leg of the outer shielding shell and extends downwards.

17. The electrical connector according to claim 16, wherein the receiving groove is opened rearwards, the grounding soldering leg of the grounding metal plate is horizontally inserted into the receiving groove from rear to front and is fixed in the receiving groove.

18. The electrical connector according to claim 14, wherein the grounding soldering leg of the grounding metal plate and the grounding soldering leg of the outer shielding shell are in form of via soldering, and can be correspondingly soldered to the same grounding soldering via of a circuit board.

19. The electrical connector according to claim 18, wherein the grounding soldering leg of the outer shielding shell and/or the grounding soldering leg of the grounding metal plate each are provided with a grabbing solder hole.

20. The electrical connector according to claim 14, wherein the electrical connector further comprises an inner shielding shell, the inner shielding shell is positioned between the outer shielding shell and the insulative body, and surrounds a rear section of the tongue portion of the insulative body and a part of the body portion adjacent to the tongue portion.

21. The electrical connector according to claim 14, wherein the grounding metal plate further comprises at least a grounding soldering leg bent from a rear end of the main plate and extending.

22. The electrical connector according to claim 14, wherein the grounding metal plate further comprises two connecting portions extending rearwards from a rear edge of the main plate, a beam extending transversally and connected with the two connecting portions, the beam is embedded in the body portion of the insulative body, the two extending portions of the grounding metal plate further extend outwards from two sides of the beam respectively.

23. The electrical connector according to claim 14, wherein the tongue portion further comprises a front surface and two side surfaces which are positioned between the first surface and the second surface, and wherein the grounding metal plate further comprises two protective portions extending respectively from two sides of a front end of the main plate, each protective portion at least comprises a guiding surface exposed on a transitional position between the front surface and the side surfaces of the tongue portion.

24. The electrical connector according to claim 14, wherein the first conductive terminals, the second conductive terminals and the grounding metal plate are embedded in a first insulative member, a second insulative member and a third insulative member, respectively, and wherein the first insulative member is provided on the third insulative member, the first insulative member and the second insulative member interpose the third insulative member therebetween.

25. The electrical connector according to claim 24, wherein the third insulative member is provided with the tongue portion thereon, the first surface of the tongue portion is formed with a group of first terminal receiving grooves thereon, the second surface of the tongue portion is formed with a group of second terminal receiving grooves thereon, and wherein the mating portions of the first conductive terminals are correspondingly received in the first terminal receiving grooves, the mating portions of the second conductive terminals are correspondingly received in the second terminal receiving grooves.

26. The electrical connector according to claim 25, wherein a rear portion of the third insulative member is provided with a plurality of terminal receiving grooves for correspondingly receiving the second conductive terminals.

27. An electrical connector, comprising:

an insulative body comprising a body portion and a tongue portion extending forwards from the body portion, the tongue portion having a first surface and a second surface which are opposite along an up-down direction;

a plurality of conductive terminals divided into a group of first conductive terminals and a group of second conductive terminals, each conductive terminal comprising a mating portion extending forwards onto the tongue portion and a soldering portion extending out of the body portion, the mating portion of each first conductive terminal being exposed on the first surface of the tongue portion, the mating portion of each second conductive terminal being exposed on the second surface of the tongue portion;

an outer shielding shell fixed on the insulative body, having a grounding soldering leg and enclosing an outer space of the tongue portion to form a mating cavity; and a grounding metal plate comprising a main plate and an extending portion extending from the main plate, the main plate being embedded in the tongue portion and spacing the first conductive terminals apart from the second conductive terminals, the extending portion extending out from at least a side of the insulative body and electrically contacting the outer shielding shell, wherein the tongue portion further comprises a front surface and two side surfaces which are positioned between the first surface and the second surface, and wherein the grounding metal plate further comprises two protective portions extending respectively from two sides of a front end of the main plate, each protective portion at least comprises a guiding surface exposed on a transitional position between the front surface and the side surfaces of the tongue portion, wherein each protective portion is bent and extends perpendicular to the main plate, and wherein each of two side surfaces of the tongue portion is provided with a latching groove recessed inwards, the protective portion further comprises a latching surface exposed on the latching groove.

* * * * *